US007654302B2

(12) United States Patent
Hirata et al.

(10) Patent No.: US 7,654,302 B2
(45) **Date of Patent: *Feb. 2, 2010**

(54) METHOD AND APPARATUS FOR MOLDING AN UPPER AND A LOWER MOLD HAVING NO FLASK, AND A METHOD FOR REPLACING A MATCH PLATE USED THEREFOR

(75) Inventors: Minoru Hirata, Toyokawa (JP); Takayuki Komiyama, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 502 days.

This patent is subject to a terminal disclaimer.

(21) Appl. No.: 10/582,965

(22) PCT Filed: Dec. 17, 2004

(86) PCT No.: PCT/JP2004/018887

§ 371 (c)(1),
(2), (4) Date: Jun. 15, 2006

(87) PCT Pub. No.: WO2005/058528

PCT Pub. Date: Jun. 30, 2005

(65) Prior Publication Data

US 2007/0151694 A1 Jul. 5, 2007

(30) Foreign Application Priority Data

| | | |
|---|---|---|
| Dec. 18, 2003 | (JP) | 2003-420266 |
| Dec. 18, 2003 | (JP) | 2003-420273 |
| Apr. 28, 2004 | (JP) | 2004-132346 |
| Nov. 17, 2004 | (JP) | 2004-332788 |

(51) Int. Cl.

| | |
|---|---|
| ***B22C 9/00*** | (2006.01) |
| ***B22C 15/02*** | (2006.01) |
| ***B22C 15/24*** | (2006.01) |
| ***B22C 17/00*** | (2006.01) |

(52) U.S. Cl. ..... 164/20; 164/29; 164/185; 164/194; 164/201; 164/213

(58) Field of Classification Search ..... 164/18–22, 164/180–184, 194, 200–202, 214, 322, 29
See application file for complete search history.

(56) References Cited

U.S. PATENT DOCUMENTS 3,589,432 A * 6/1971 Miller et al. ..... 164/182

(Continued)

FOREIGN PATENT DOCUMENTS

| | | |
|---|---|---|
| DE | 33 12 539 C1 | 3/1984 |
| EP | 0 468 355 A2 | 1/1992 |

(Continued)

OTHER PUBLICATIONS

Office Action dated Mar. 6, 2009 in U.S. Appl. No. 11/919,909.

*Primary Examiner*—Kuang Lin
(74) *Attorney, Agent, or Firm*—Finnegan, Henderson, Farabow, Garrett & Dunner, L.L.P.

(57) ABSTRACT

A method and apparatus for molding molds having no flask wherein a match plate is put between an upper and a lower flask having intakes for foundry sand. An upper and a lower molding space are defined by inserting an upper and a lower squeeze device into openings of a pair of the upper and the lower flask having no match plate, and a pair of the upper and the lower flask and the match plate are rotated and moved so that they become perpendicular, and are moved so that the intakes of the flasks move upward. The upper and the lower molding space are filled with the foundry sand. The foundry sand in the molding spaces is squeezed by the squeeze devices. A pair of the flasks and the match plate are rotated so that they become horizontal. Then the match plate is removed. While the preceding processes are being carried out, if necessary a core can be installed between the molds, the flasks are matched to each other, and the molds are removed from the pair of flasks.

16 Claims, 16 Drawing Sheets

U.S. PATENT DOCUMENTS

| | | | | |
|---|---|---|---|---|
| 4,463,794 | A | 8/1984 | Shioda | |
| 4,541,476 | A * | 9/1985 | Larsen | 164/182 |
| 4,791,974 | A | 12/1988 | Larsen | |
| 5,246,058 | A * | 9/1993 | Murata | 164/182 |
| 6,470,953 | B1 * | 10/2002 | Hirata et al. | 164/37 |
| 6,499,531 | B1 | 12/2002 | Knudsen | |

FOREIGN PATENT DOCUMENTS

| | | |
|---|---|---|
| EP | 1 208 928 A1 | 5/2002 |
| JP | 56-119645 | 9/1981 |
| JP | 62-16736 | 4/1987 |
| JP | 3-243243 | 10/1991 |
| WO | WO 00/50187 A | 8/2000 |

* cited by examiner

METHOD AND APPARATUS FOR MOLDING AN UPPER AND A LOWER MOLD HAVING NO FLASK, AND A METHOD FOR REPLACING A MATCH PLATE USED THEREFOR

TECHNICAL FIELD

This invention relates to a method and apparatus for molding an upper and a lower mold having no flask. Further, it relates to a method and apparatus for replacing a match plate used therefor.

BACKGROUND OF THE INVENTION

Conventionally, as one of the molding machines of this type, there is the following apparatus, comprising:

a first station, which is disposed above a base, for compressing foundry sand in a molding space by squeezing the sand in a horizontal direction, a second station, which is disposed near a lower surface of the base, for matching an upper mold with a lower mold in a perpendicular direction against the lower surface of the base and for removing flasks, wherein two sets of the upper and the lower flask are alternately reciprocated between the first and the second station, and wherein an upper and a lower mold that match each other and that have no flask are molded.

However, the conventional molding machine for molding an upper and a lower mold having no flask has problems to be solved, such as it is not efficient enough, it is necessary to improve the quality of the mold and the procedure for replacing the match plate, or the molding machine should be smaller.

Patent document 1: Examined Japanese Patent Application Publication No. S62-16736

DISCLOSURE OF INVENTION

This invention intends to provide an improved method and apparatus for molding an upper and a lower mold that match each other and that have no flask, and which can solve the problems of the conventional apparatus, such as the conventional apparatus not being efficient enough, it is necessary to improve the quality of the mold and the procedure for replacing the match plate, or the molding machine should be smaller.

The first invention is constituted of the following elements to solve these problems.

A method for molding an upper and a lower mold that match each other and that have no flask, comprising:

a process to put a match plate that is between an upper and a lower flask having an intake for foundry sand and to hold the match plate, wherein the match plate and the upper and the lower flask are horizontal, a process to define an upper and a lower molding space by inserting an upper and a lower squeeze means into openings of a pair of the upper and the lower flask having no match plate, a process to rotate the pair of the upper and the lower flask and the match plate so that they are perpendicularly positioned, and to move them so that the intakes of the upper and the lower flask move upward, a process to fill the upper and the lower molding space with the foundry sand through the intakes of the upper and the lower flask, a process to squeeze the foundry sand of the upper and the lower molding space by causing the upper and the lower squeeze means to further approach each other, a process to rotate the pair of the upper and the lower flask and the match plate so that they are horizontally positioned, and a process to remove the match plate disposed between the upper and the lower flask after separating the upper and the lower flask containing a mold from the match plate, wherein, while the preceding processes are being carried out, if necessary the core is installed between the upper and the lower mold, the upper and the lower flask containing the mold are caused to match each other, and the molds are removed from the pair of the upper and the lower flask that match each other.

According to this invention, since a molding process to make the molds in a pair of the upper and the lower flask and a process to remove the molds which have already been made from the upper and the lower flask proceed simultaneously, it is possible to make an upper and a lower mold having no flask faster and more efficiently compared with the conventional method.

The second invention is constituted by the following elements to solve the problems.

The method of the first invention, wherein the process to define the upper and the lower molding space by inserting the upper and the lower squeeze means into the openings of a pair of the upper and the lower flask having no match plate, and the process to rotate a pair of the upper and the lower flask and the match plate so that they are perpendicularly positioned, and to move them so that the intakes of the upper and the lower flask move upward, simultaneously proceed.

According to this invention, it is possible to improve the productivity of the molds.

The third invention is constituted of the following elements to solve the problems.

The method of the first invention, wherein the process to squeeze the foundry sand of the upper and the lower molding space by causing the upper and the lower squeeze means to further approach each other, and the process to rotate a pair of the upper and the lower flask and the match plate so that they are horizontally positioned proceed simultaneously.

The fourth invention is constituted of the following elements to solve the problems.

The method of the first invention, wherein the upper and the lower squeeze plate are provided as the upper and the lower squeeze means.

According to this invention, a simpler method for molding the molds can be provided by using the apparatus for molding the upper and the lower mold having no flask.

The fifth invention is constituted of the following elements to solve the problems.

The method of the first invention, wherein the upper and lower segmented-squeeze feet are provided as the upper and the lower squeeze means.

According to this invention, an upper and a lower mold that are more uniform, and that have a high quality, and foundry sand having a high density, can be molded.

The sixth invention is constituted of the following elements to solve the problems.

The method of the fourth invention, further comprising a process to move further apart the upper squeeze plate from the lower squeeze plate to a predetermined distance, and the process to fill the upper and the lower molding space with the additional foundry sand through the intakes of the upper and the lower flask, after the process to fill the molding space with the sand through the intakes is completed.

According to this invention, further, an upper and a lower mold that are more uniform, and that have a high quality, and foundry sand having a high density, can be molded.

The seventh invention is constituted of the following elements to solve the problems.

The method of the sixth invention, wherein the process to move further apart the upper squeeze plate from the lower squeeze plate to a predetermined distance, and the process to fill the upper and the lower molding space with the additional foundry sand through the intakes of the upper and the lower flask, proceed simultaneously.

According to this invention, further, an upper and a lower mold that are more uniform, and that have a high quality, and foundry sand having a high density, can be molded.

The eighth invention is constituted of the following elements to solve the problems.

The method of the fifth invention, wherein the process to define the upper and the lower molding space by inserting the upper and the lower squeeze means into openings of a pair of the upper and the lower flask having no match plate further includes a setting process to set the distance between the pattern of the match plate and each of a plurality of the upper and lower segmented-squeeze feet so that each of the ratios between the distance after squeezing and that before squeezing becomes equal.

According to this invention, further, upper and lower molds that are more uniform, and that have a high quality, and foundry sand having a high density, can be molded.

The ninth invention is constituted of the following elements to solve the above problems.

The method of the fifth invention, wherein the process to define the upper and the lower molding space by inserting the upper and the lower squeeze means into openings of a pair of the upper and the lower flask having no match plate further includes a forming process to form the molding space defined by the pattern of the match plate and each of a plurality of the upper and lower segmented-squeeze feet so that the foundry sand can easily flow in the molding space.

According to this invention, further, an upper and a lower mold that are more uniform, and that have a high quality, and foundry sand having a high density, can be molded.

The tenth invention is constituted of the following elements to solve the problems.

The method of the ninth invention, wherein the process to form the molding space defined by the pattern of the match plate and each of a plurality of the upper and lower segmented-squeeze feet so that the foundry sand can easily flow in the molding space further includes a process to reduce the friction between the foundry sand and a wall of an aeration tank by jetting air into a nozzle (especially, a nozzle throat) of the aeration tank and the portion where it is difficult for the foundry sand to flow.

According to this invention, further, an upper and a lower mold that are more uniform, and that have high quality, and foundry sand having a high density, can be molded.

The eleventh invention is constituted of the following elements to solve the problems.

The method of the fifth invention, wherein the process to fill the upper and the lower molding space with the foundry sand through the intakes of the upper and the lower flask and the process to squeeze the foundry sand of the upper and the lower molding space by causing the upper and the lower squeeze means to further approach each other further include:

a first filling process to fill the upper and the lower molding space defined by the upper and the lower flask, the upper and the lower squeeze means, and the match plate, which are perpendicular, with the foundry sand through the intakes of the upper and the lower flask, a first squeezing process to squeeze the foundry sand of the upper and the lower molding space by causing a plurality of the upper and lower segmented-squeeze feet of the upper and the lower squeeze means to further approach each other, a second filling process to fill the upper and the lower molding space with the additional foundry sand through the intakes of the upper and the lower flask after the retracting process to retract the upper and lower segmented-squeeze feet is completed, and a second squeezing process to squeeze the foundry sand of the upper and the lower molding space by simultaneously causing the upper and lower segmented-squeeze feet, whose surfaces are arranged in a plane, to approach each other.

According to this invention, further, upper and lower molds that are more uniform, and that have a high quality, and foundry sand having a high density, can be molded.

The twelfth invention is constituted of the following elements to solve the above problems.

An apparatus for molding an upper and a lower mold matched to each other and having no flask, comprising:

two pairs of an upper and a lower flask having an intake disposed at their side walls for foundry sand, a match plate disposed between one of the two pairs of the upper and the lower flask so that the match plate can be inserted and taken out by a conveying apparatus, a squeezing mechanism to squeeze the foundry sand, which supports the pair of the upper and the lower flask having the match plate between them, which supports an upper and a lower squeeze means inserted into openings of the upper and the lower flask having no match plate so that the squeeze means can be taken out, and which can clockwise or counterclockwise rotate in a perpendicular plane about a supporting shaft so that the pair of the upper and the lower flask having the match plate between them can become perpendicular and horizontal, a driving mechanism to clockwise or counterclockwise rotate the squeezing mechanism, an aeration mechanism to discharge the foundry sand into the upper and the lower flask, which are perpendicular, by the driving mechanism through the intake, a removing mechanism to remove an upper and a lower mold from a pair of the upper and the lower flask containing a mold, matched to each other, and which are horizontal, and a rotating mechanism to alternately and intermittently rotate the two pairs of the upper and the lower flask, which are horizontal, between the squeezing mechanism, which is horizontal, and the removing mechanism, and to lift and lower the upper flask.

The apparatus according to the twelfth invention, can, on one hand, make a pair of molds in flasks, and on the other hand, can remove the molds from a pair of the upper and the lower flask containing molds that have been molded already.

Thus, it is possible to make upper and lower molds having no flask faster and more efficiently compared with the conventional apparatus.

The thirteenth invention is constituted of the following elements to solve the problems.

The apparatus of the twelfth invention, wherein the upper and the lower squeeze plate are provided as the upper and the lower squeeze means.

According to this invention, a simpler apparatus for molding an upper and a lower mold having no flask can be provided.

The fourteenth invention is constituted of the following elements to solve the problems.

The apparatus of the twelfth invention, wherein the upper and lower segmented-squeeze feet are provided as the upper and the lower squeeze means.

According to this invention, an upper and a lower mold that are more uniform, and that have a high quality, and foundry sand having a high density, can be molded.

The fifteenth invention is constituted of the following elements to solve the problems.

The apparatus of any of the 12th, 13th, and 14th inventions, wherein the removing mechanism to remove an upper and a lower mold is comprised of a supporting member to support the molds, which have a rectangular plate, and which can be lifted and lowered, and which can be inserted in the lower flask, a lower fluid cylinder disposed under the supporting member to hoist the supporting member, a lower lifting and lowering table, wherein the lower fluid cylinder is disposed under the lower lifting and lowering table, a lower folding and retractable mechanism to lift and lower the lower lifting and lowering table, which is disposed under the lower lifting and lowering table, a pressing member to press the molds out, which has a rectangular plate, is disposed above the supporting member at a set distance away, and can be moved up and down and inserted in the upper flask, an upper fluid cylinder disposed above the pressing member to lift and lower the pressing member, an upper lifting and lowering table, wherein the upper fluid cylinder is disposed above the upper lifting and lowering table, and an upper folding and retractable mechanism to lift and lower the upper lifting and lowering table, which is disposed above the upper lifting and lowering table.

According to this invention, it is possible to reduce the height of the removing mechanism.

The sixteenth invention is constituted of the following elements to solve the problems.

The apparatus of the fifteenth invention, wherein the lower and the upper folding and retractable mechanism of the removing mechanism are each a toggle mechanism or a pantograph mechanism.

According to this invention, it is possible to further reduce the height of the removing mechanism.

The seventeenth invention is constituted of the following elements to solve the problems.

The apparatus of either of the 15th and 16th inventions, wherein the upper and the lower fluid cylinder of the removing mechanism are a hydraulic cylinder and a pneumatic cylinder respectively.

According to this invention, it is possible to further reduce the height of the removing mechanism.

The eighteenth invention is constituted of the following elements to solve the problems.

A method for replacing the match plate by using the rotating mechanism of the apparatus of any of the 12th, 13th, and 14th inventions, comprising:

a process to raise the two upper flasks of the two pairs of the upper and the lower flask, a process to carry the match plate to the upper flask positioned at the squeezing mechanism by a carriage, a process to carry the match plate to the upper flask positioned at the removing mechanism by a carriage, a process to move the match plate positioned at the squeezing mechanism to the removing mechanism, and to move the match plate positioned at the removing mechanism to the squeezing mechanism by driving the rotating mechanism, and a process to carry out two match plates that are rotated and moved between the squeezing mechanism and the removing mechanism.

By the method according to the eighteenth invention, it is possible to replace the match plate faster and more efficiently compared with the conventional method.

BRIEF DESCRIPTIONS OF THE DRAWINGS

FIG. 5(*b*) shows an operational view indicating some of the processes for replacing a match plate using the apparatus shown in FIG. 1, and consists of a plane view located at the upper part and an elevational view located at the lower part.

FIG. 6(*b*) shows an operational view indicating some of the processes for replacing a match plate using the apparatus shown in FIG. 1, and consists of a plane view located at the upper part and an elevational view located at the lower part.

FIG. 7(*b*) shows an operational view indicating some of the processes for replacing a match plate using the apparatus shown in FIG. 1, and consists of a plane view located at the upper part and an elevational view located at the lower part.

Figure 8:
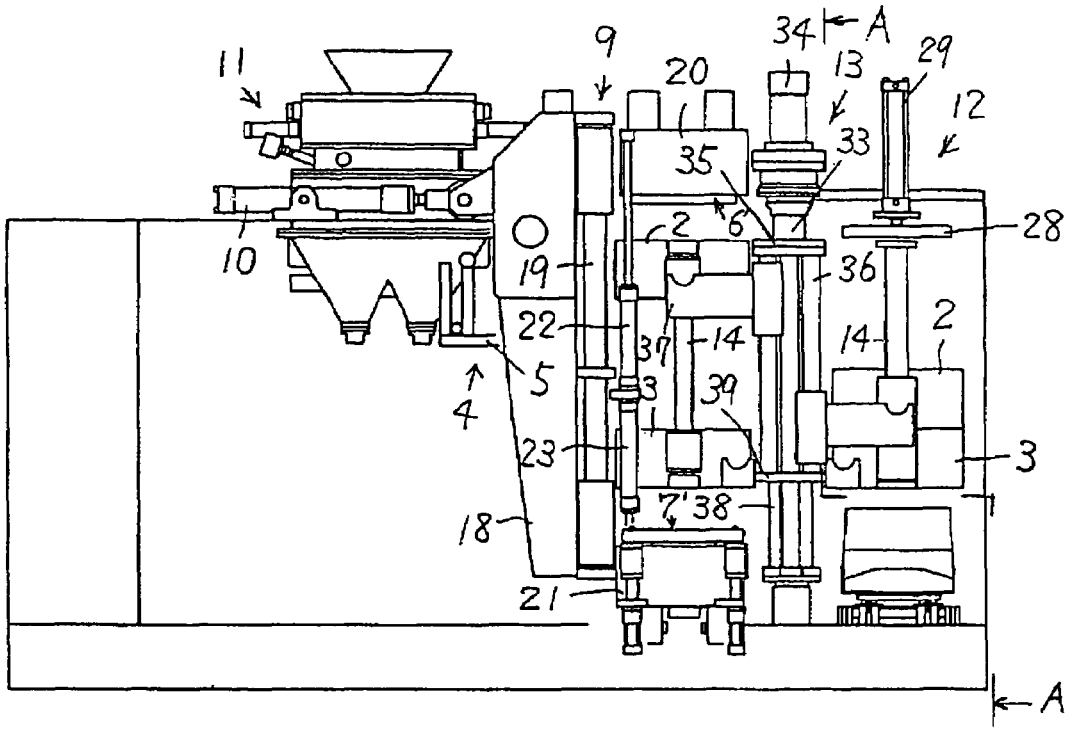
FIG. 8 shows an elevational view of an apparatus for molding a mold of the preferred embodiment of the invention using segmented-squeeze feet as a squeeze means.
Figure 12:
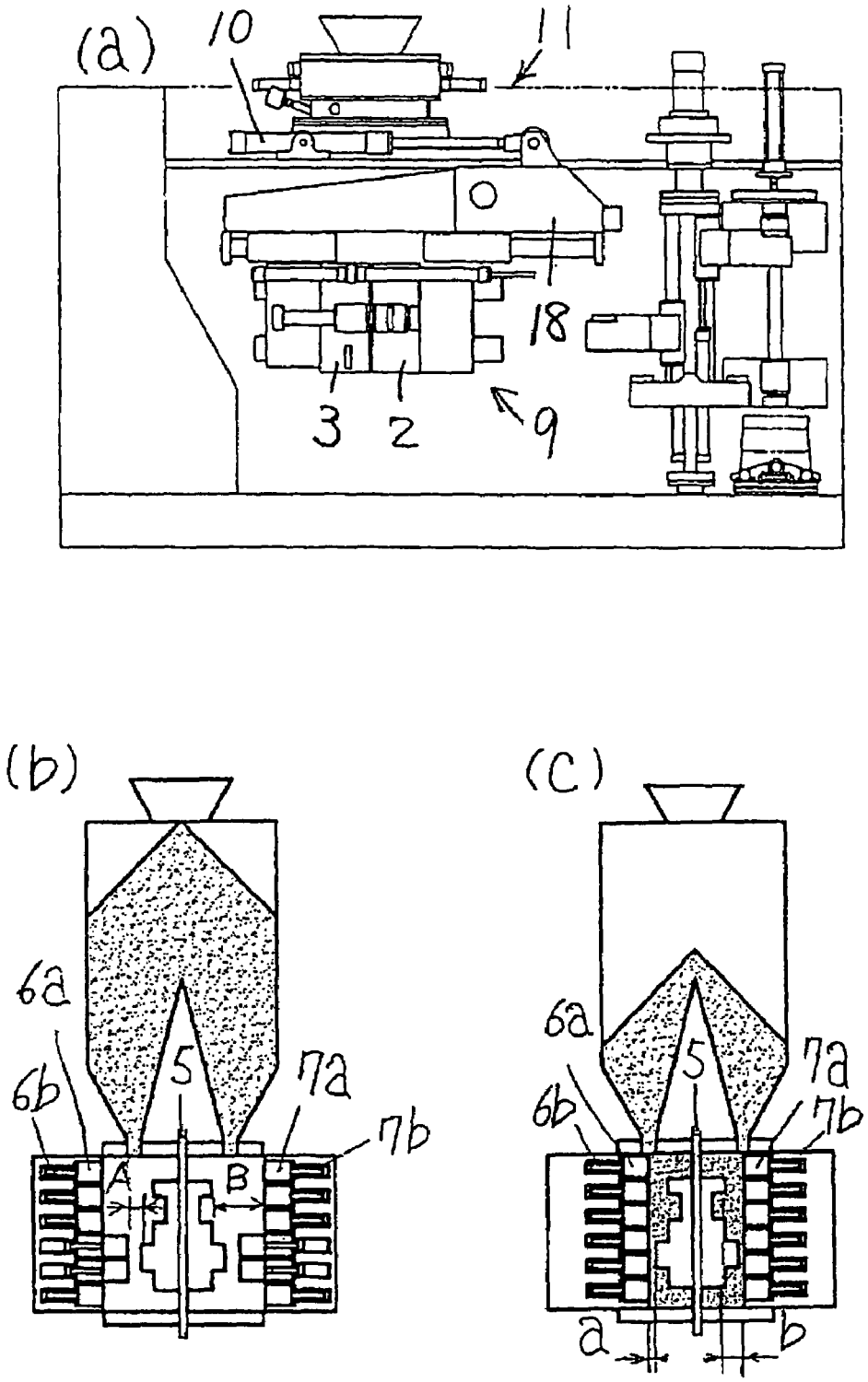

FIGS. 12(*a*)-(*c*) show operational views indicating some of the processes for molding the mold by an apparatus for molding the upper and the lower mold, which have no flask, shown in FIG. 8.

Figure 13:
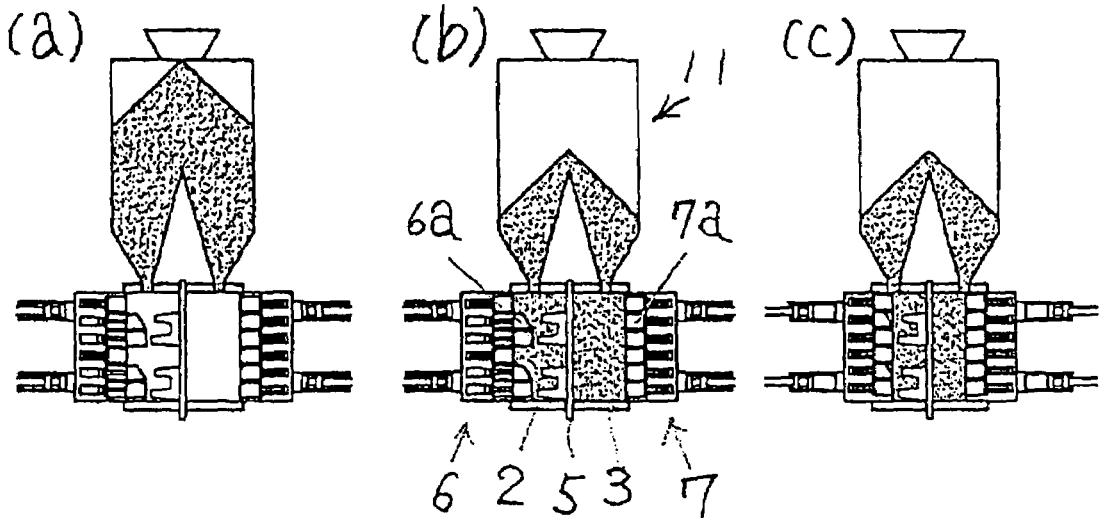

FIGS. 13(*a*)-(*c*) show operational views indicating some of the processes for molding the mold by an apparatus for molding the upper and the lower mold. It does not show the flask shown in FIG. 8.

Figure 14:
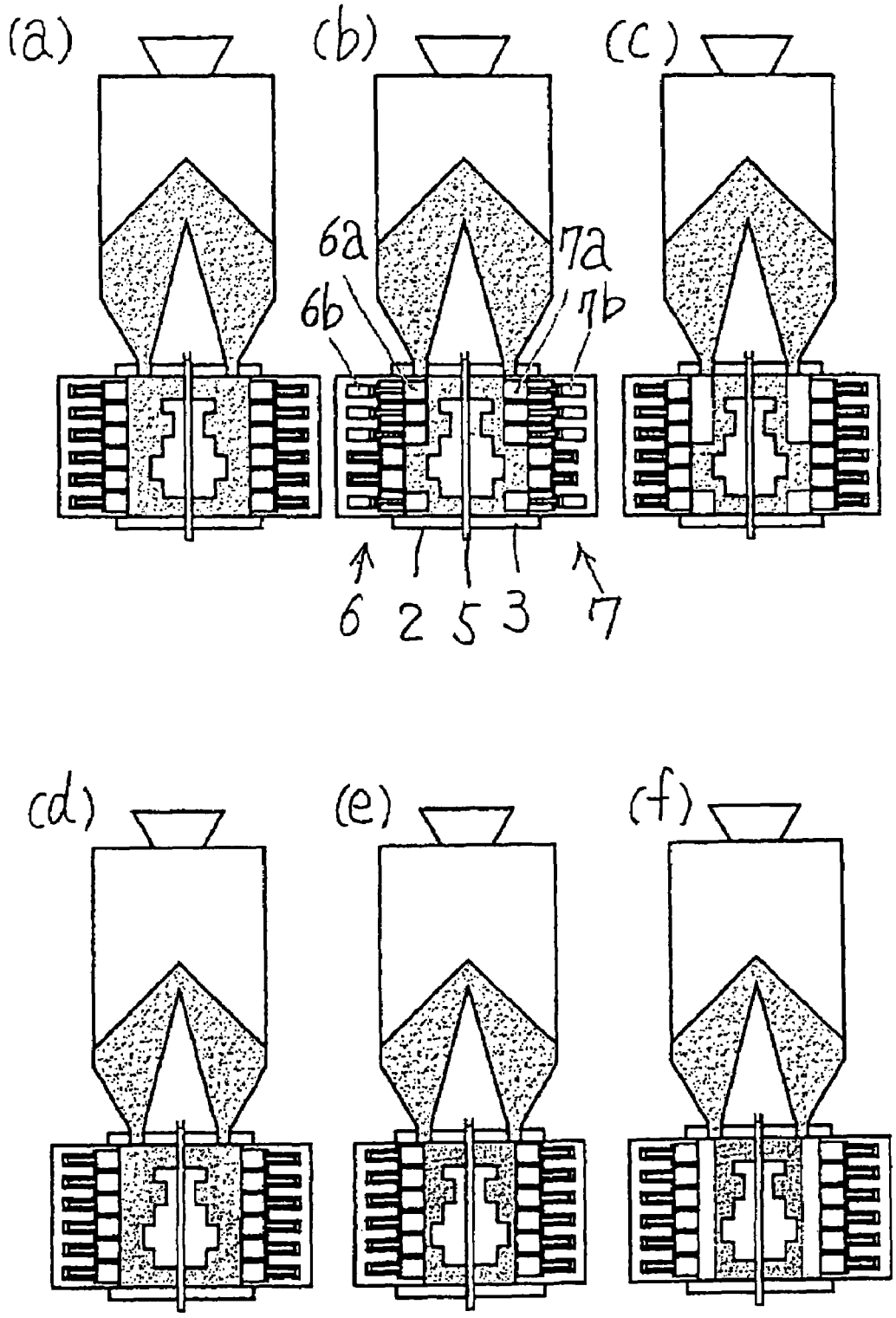

FIGS. 14(*a*)-(*f*) show operational views indicating some of the processes for molding the mold by an apparatus for molding the upper and the lower mold. It does not show the flask shown in FIG. 8.

Figure 15:
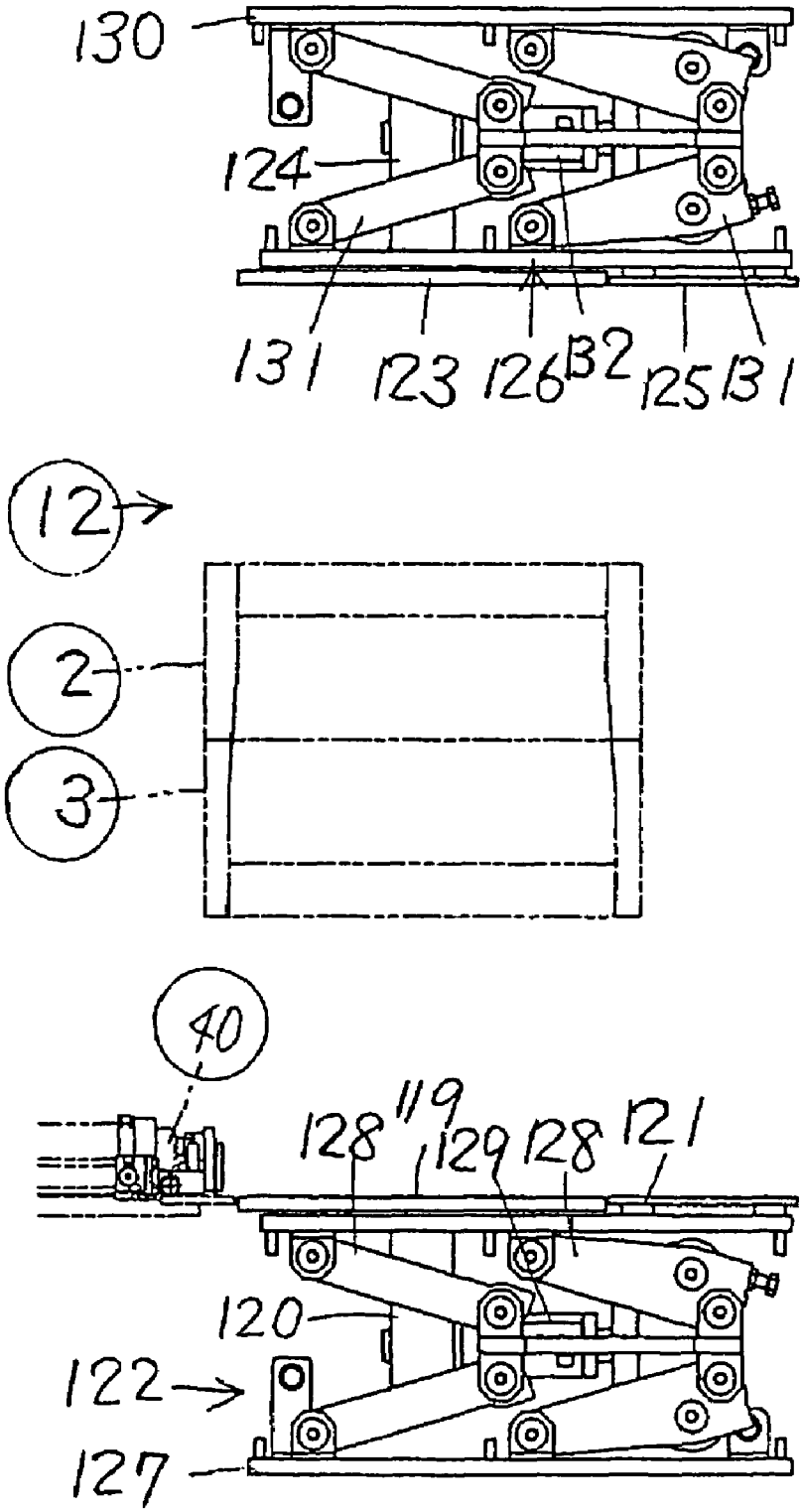

FIG. 15 shows the second embodiment of a removing mechanism to remove a mold from a flask, and indicates a right side view.

Figure 16:
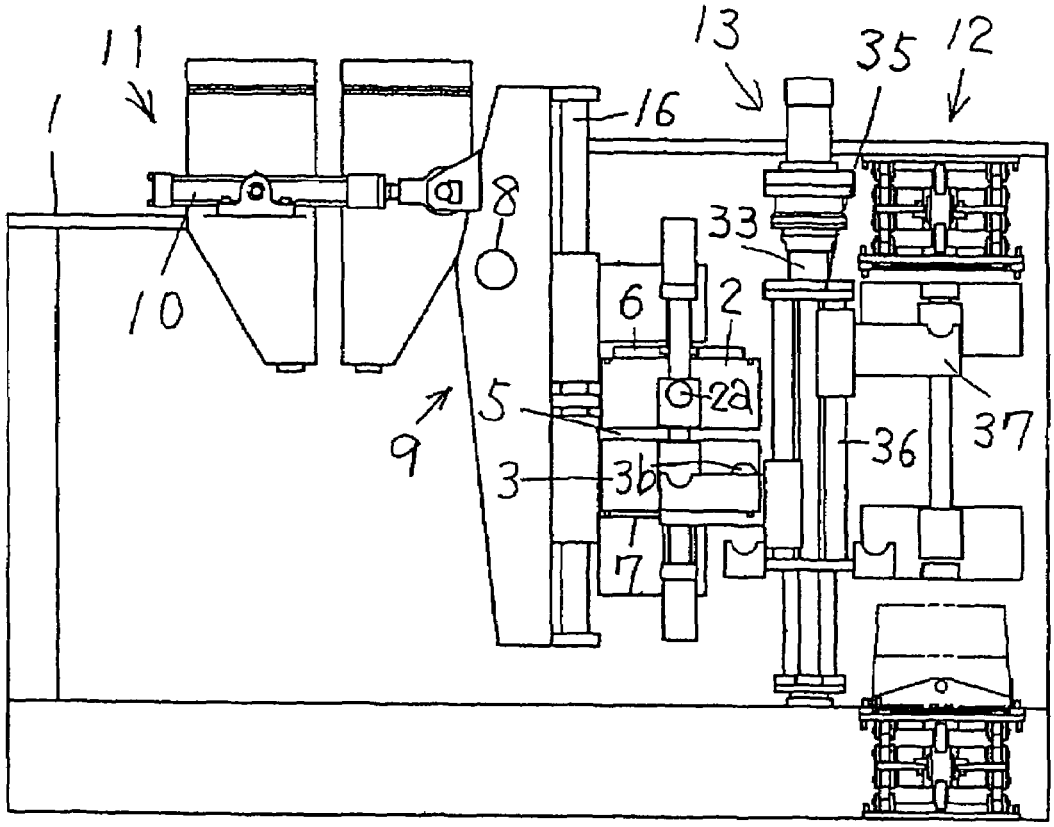

FIG. 16 shows an elevational view of an apparatus for molding the upper and the lower mold, which have no flask, using the second embodiment of a removing mechanism to remove a mold from a flask, and indicates the right side view.

Figure 17:
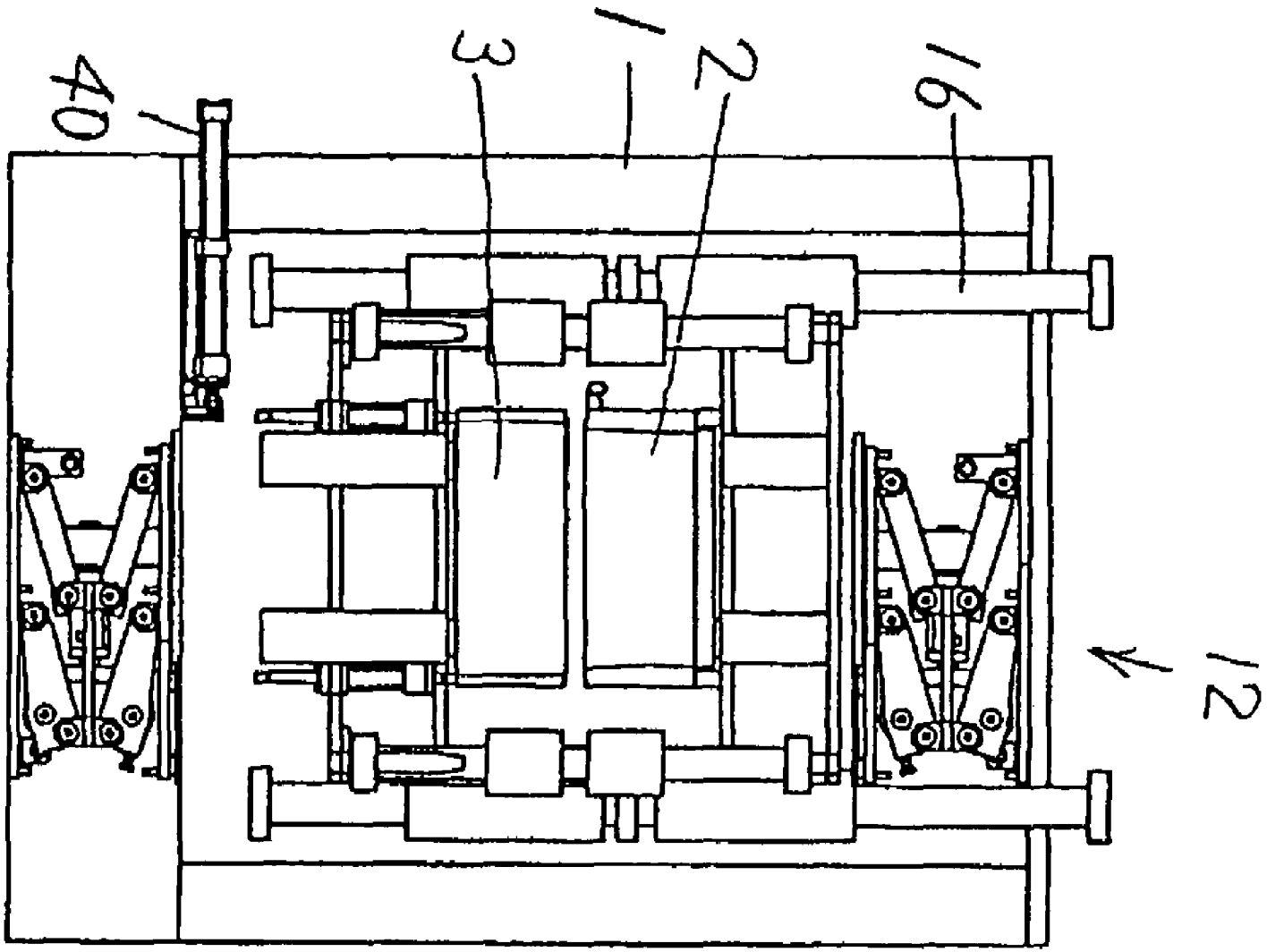

FIG. 17 shows a right side view of FIG. 16.

Figure 18:
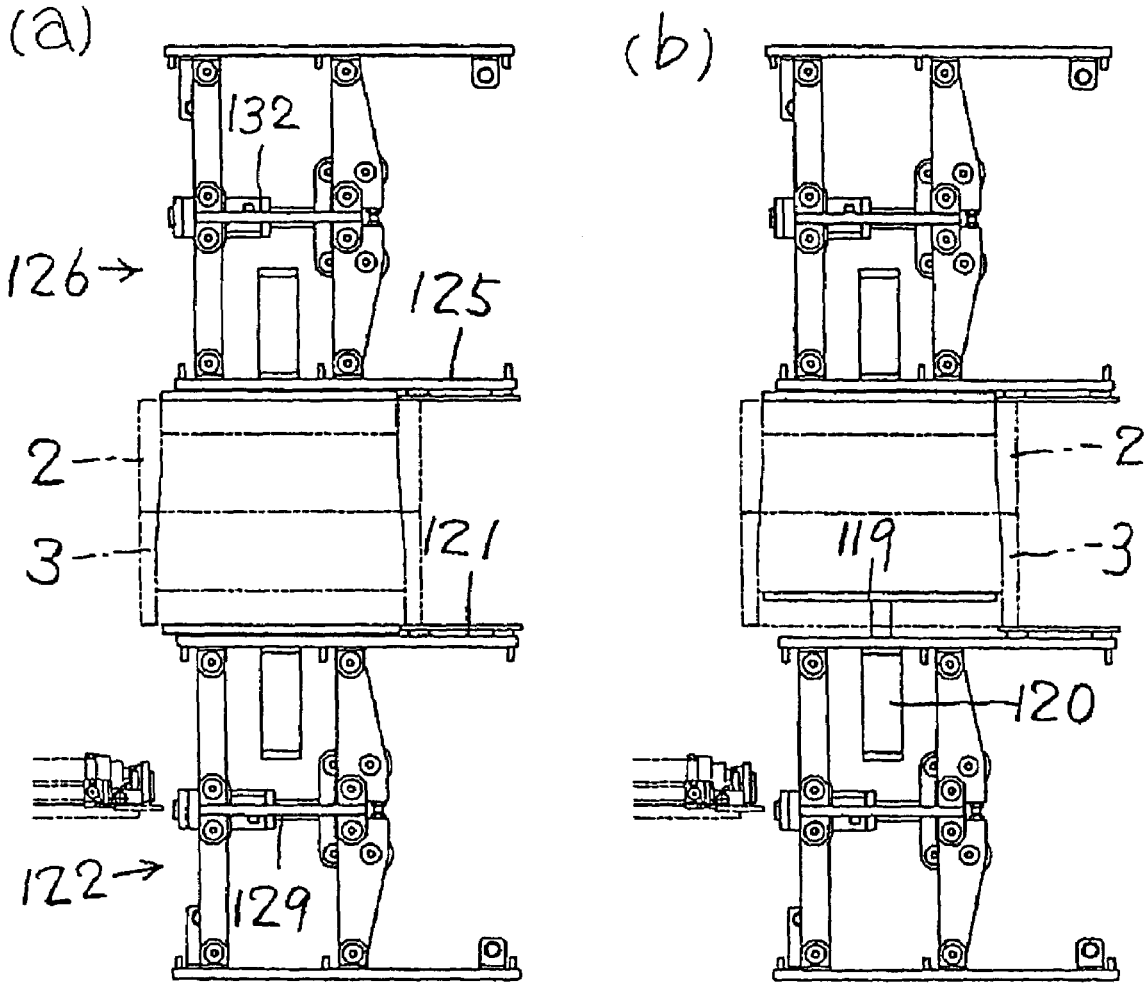

FIG. 18(*a*) shows an operational view indicating some of the processes for removing an upper and a lower mold from a pair of an upper and a lower flask containing a mold by the removing mechanism shown in FIG. 15 and a right side view.

FIG. 18(*b*) shows an operational view indicating some of the processes for removing an upper and a lower mold from a pair of an upper and a lower flask containing a mold by the removing mechanism shown in FIG. 15, and a right side view.

Figure 19:
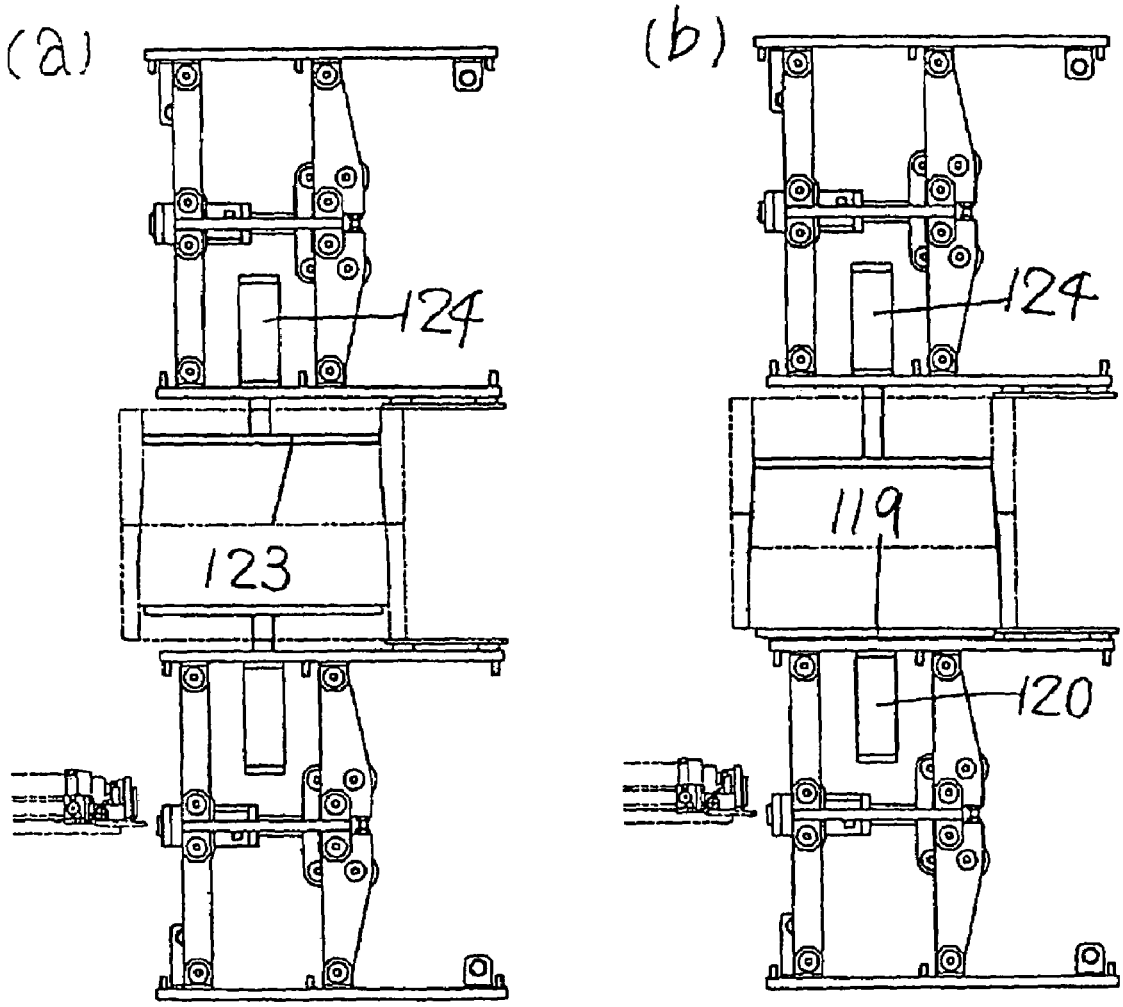

FIG. 19(*a*) shows an operational view indicating some of the processes for removing an upper and a lower mold from a pair of an upper and a lower flask containing a mold by the removing mechanism shown in FIG. 15, and right side view.

FIG. 19(*b*) shows an operational view indicating some of the processes for removing an upper and a lower mold from a pair of an upper and a lower flask containing a mold by the removing mechanism shown in FIG. 15 and a sight side view.

Figure 20:
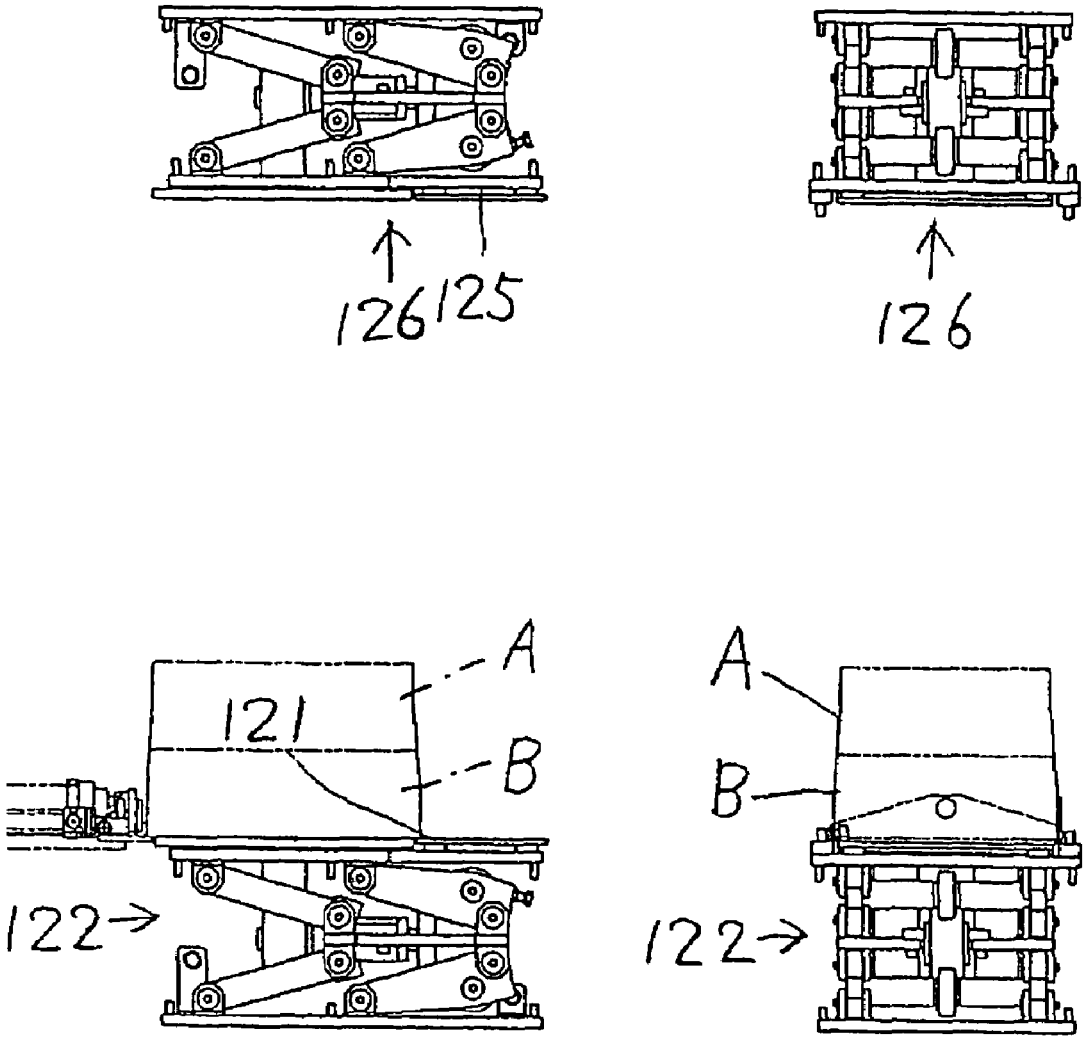

FIG. 20 shows an operational view indicating some of the processes for removing an upper and a lower mold from a pair of an upper and a lower flask containing a mold by the removing mechanism shown in FIG. 15, and a right side view and an elevational view.

PREFERRED EMBODIMENTS OF THE INVENTION

Embodiments of this invention for an apparatus for molding an upper and a lower mold having no flask are now explained in detail based on the figures.

Figure 1:
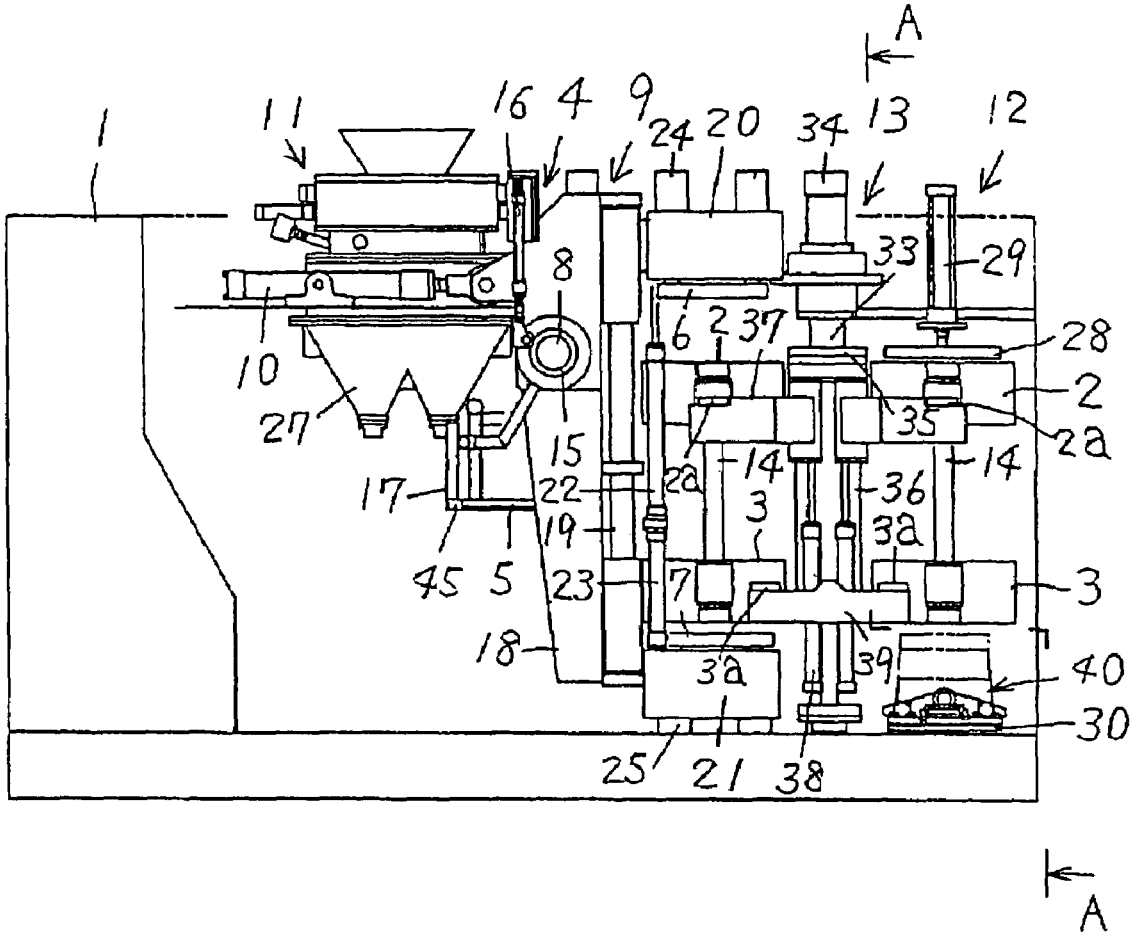
FIG. 1 shows an elevational view and a partial section view of an apparatus for molding a mold of the preferred embodiment of the invention, using a squeeze plate as a squeeze means.
Figure 2:
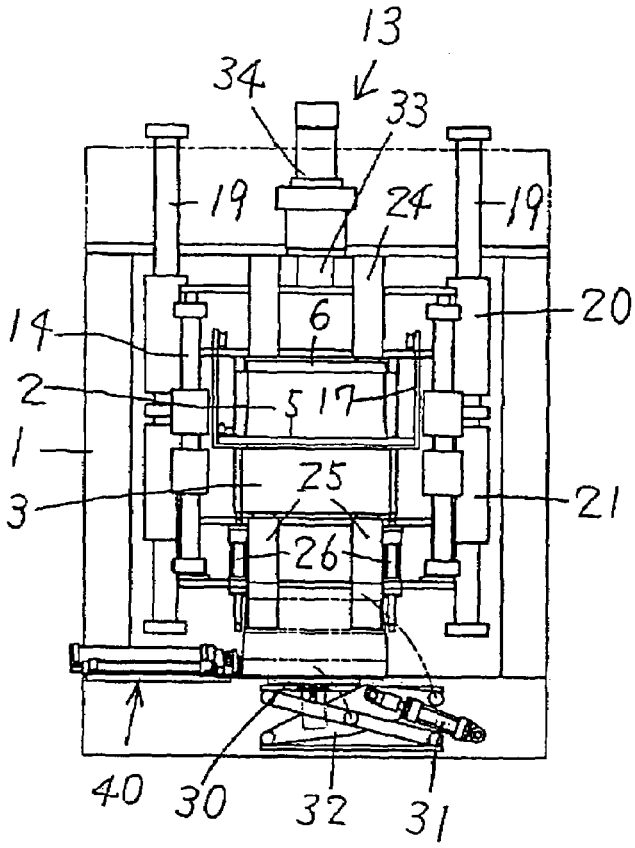
FIG. 2 shows an A-A section, and the condition of holding the match plate 5 between the upper and the lower flask 2, 3.
Figure 3:
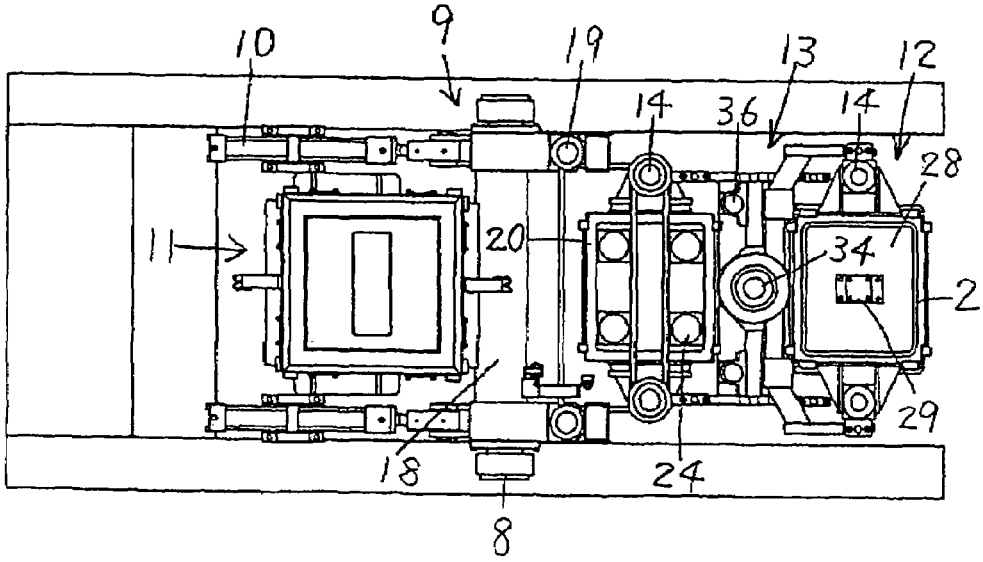
FIG. 3 shows a plane view of FIG. 1.

FIGS. 1-3 show an apparatus for molding an upper and a lower mold having no flask, using an upper and a lower squeeze plate as the upper and the lower squeeze means.

The apparatus for molding the upper and the lower mold having no flask includes:

a base 1 having an internal space and a rectangular parallelepiped configuration, two pairs of an upper and a lower flask 2, 3, 2, 3 having intakes disposed at their side walls for foundry sand, a match plate 5 disposed between one of the two pairs of the upper and the lower flask 2, 3, 2, 3 so that the match plate can be inserted and taken out by a conveying apparatus 4, a squeezing mechanism 9 to squeeze the foundry sand, which supports a pair of the upper and the lower flask 2, 3 having the match plate 5 between the upper and the lower flask 2, 3, which supports the upper and the lower squeeze plate 6, 7 as the squeeze means inserted into openings of the upper and the lower flask having no match plate 5 so that the squeeze means can be taken out, and which can rotate clockwise or counterclockwise in a perpendicular plane about a supporting shaft 8 disposed on the base 1 so that the pair of the upper and the lower flask 2, 3 having the match plate 5 between the upper and the lower flask 2, 3 can be perpendicular or horizontal respectively, a cylinder 10 disposed in the horizontal direction as a driving mechanism to rotate the squeezing mechanism 9 clockwise or counterclockwise, an aeration mechanism 11 to discharge the foundry sand into the upper and the lower flask 2, 3, which are perpendicular, by the cylinder 10, through the intakes of the upper and the lower flask, a removing mechanism 12 to remove an upper and a lower mold from the pair of the upper and the lower flask 2, 3 containing a mold, matched to each other, and which are horizontal, and a rotating mechanism 13 to alternately and intermittently rotate the two pairs of the upper and the lower flask 2, 3, which are horizontal, between the squeezing mechanism 9, which is horizontal, and the removing mechanism 12, and to lift and lower the upper flask 2.

In the upper and the lower flask 2, 3, a pair of connecting rods 14, 14 is hung from the front and the rear outer surface of the upper flask 2, and the lower flask 3 is slidably connected to the connecting rods 14, 14 as shown in FIG. 1. The lower flask 3 is stopped at the lower end of the connecting rods 14, 14. Further, protuberances 2*a*, 2*a*, 3*a*, 3*a* are disposed at the center of the front and the rear outer surface of the upper flask 2 and at the right side of the front and the rear outer surface of the lower flask 3 in the state wherein the lower flask 3 is positioned on the squeezing mechanism 9.

The conveying apparatus 4 for carrying the match plate 5 includes:

a ring member 15 disposed on the surface of the supporting shaft 8 of the squeezing mechanism 9, a cylinder 16 connected to the aeration mechanism 11 at its base end and rotatably connected to the portion of the ring member 15 at the distal end of the piston rod of the cylinder 16, a pair of arms 17, 17 fixed to the ring member 15 at its end as a cantilever structure, and a carriage 45 hung so as to be able to hold the match plate 5 and reciprocate from side to side, as shown in FIG. 1.

The pair of the arms 17, 17 rotate by means of the telescopic movement of the cylinder 16. Then the carriage 45 can insert the match plate 5 between the pair of the upper and the lower flask 2, 3 on the squeezing mechanism 9, which is horizontal, and can remove the match plate 5 from them through rails 46, 47, explained below. (See FIGS. 5-7.)

The carriage 45 descends a small distance by the rotation of the arms 17, 17 by the telescopic movement of the cylinder 16. Consequently, the arms 17, 17 can be connected to or disconnected from the carriage 45.

In the squeeze mechanism 9, as shown in FIG. 1, a central portion of a rotating frame 18 is disposed at the supporting shaft 8 disposed at the upper and the central portion of the base 1 so that the rotating frame 18 can rotate clockwise or counterclockwise in the perpendicular plane.

A pair of guide rods 19, 19, extending vertically, are disposed at the right side of the rotating frame 18 with a set interval in the direction connecting the front and back sides of the rotating frame 18.

An upper lifting and lowering frame 20, having a reverse L-shaped configuration, is slidably disposed at the upper portion of the guide rods 19, 19 through a holder portion fixed to the lifting and lowering frame 20. Also, a lower lifting and lowering frame 21, having an L-shaped configuration, is slidably disposed at the lower portion of the guide rods 19, 19 through a holder portion fixed to the lifting and lowering frame 21.

The upper and the lower lifting and lowering frame 20, 21 can access and separate from each other by driving a cylinder 22 arranged upward and a cylinder 23 arranged downward.

Rails 46 are fixed to the rotating frame 18 so that when the pair of the upper and the lower flask are horizontal, the carriage 45 can be guided.

Rails 47 for guiding the carriage 45 are disposed at the upper flasks 2, 2 and reach the same level as the rails 46 when the upper flasks 2, 2 go upward. (See FIGS. 5-7.)

A plurality of the cylinders 24, 24 to move the squeeze plate 6 forward or backward are disposed at the upper lifting and lowering frame 20.

Also, a plurality of the cylinders 25, 25 to move the squeeze plate 7 forward or backward are disposed at the lower lifting and lowering frame 21.

The upper and the lower lifting and lowering frame 20, 21 each have a large and horizontal flat surface so as to push the upper and the lower flask 2, 3.

The aeration mechanism 11 is disposed at the upper-left side portion of the base 1, and is comprised of two aeration tanks 27, 27.

The aeration mechanism 11 can discharge the foundry sand into the upper and the lower flask independently by means of low-pressure air (filling the foundry sand by aeration).

An air pressure of 0.05 Mpa-0.18 Mpa is preferable to aerate the foundry sand. Further, it is possible to use vacuum pressure to aerate the foundry sand by having the aeration tanks communicate with the vacuum pressure source (not shown).

The aeration tanks 27, 27 may be operated at the same time by controlling them simultaneously by two controllers or by controlling them by one controller.

In the removing mechanism 12, a pushing member 28, which is fixed at the distal end of the piston rod of the cylinder 29, is arranged downward and fixed to the upper portion of the base 1. It can be inserted in the upper and the lower flasks 2, 3, which match each other, and which are horizontal, and which can move up and down by driving the cylinder 29.

A supporting member 30 is disposed below the pushing member 28, which supports the upper and the lower mold that are removed from the upper and the lower flask 2, 3, and which can move up and down by means of a pantograph mechanism driven by a cylinder 31.

Namely, since the pantograph mechanism is used to move the supporting member 30, it is unnecessary to provide a pit for the removing mechanism 12. (See FIG. 2.)

In the rotating mechanism 13, a rotating shaft 33 extending upward and downward is rotatably disposed at the base 1. The distal end of the rotating shaft 33 is connected to an output shaft of a motor 34 fixed to the upper end of the base 1. The rotating shaft 33 can be rotated clockwise or counterclockwise for 180 degrees by the motor 34.

A supporting element 35 is disposed at the top of the rotating shaft 33. Two pairs of guide rods 36, 36 extending downward are hung from the support element 35 with a set interval in the direction connecting the front and the back side of the rotating mechanism 13.

Two pairs of the guide rods 36, 36 are symmetrically located about the rotating shaft 33.

Upper hooks 37 for hooking the protuberances 2*a*, 2*a* of the upper flask 2 are slidably disposed at each of the two pairs of the guide rods 36, 36.

The hooks 37 are fixed to the distal end of the piston rod of a cylinder 38 arranged vertically and connected to the rotating shaft 33. The hooks 37 can move up and down by driving the cylinder 38.

Lower hooks 39 for hooking the protuberances 3*a*, 3*a* of the lower flask 3 are disposed at the lower ends of the two pairs of the guide rods 36, 36.

A symbol 40, shown in the figures, indicates an apparatus for taking out the upper and the lower mold that are removed from the upper and the lower flask 2, 3 from the supporting member 30.

FIGS. 8-14 show an apparatus using the upper and lower segmented-squeeze feet as the upper and the lower squeeze means for molding the upper and the lower mold having no flask.

The difference between the apparatus using the upper and lower segmented-squeeze feet as the upper and the lower squeeze means and using the upper and lower squeeze plate as the ones for molding the upper and the lower mold having no flask is the use of a plurality of the upper and lower segmented-squeeze feet 6*a*, 6*a*, 7*a*, 7*a* instead of the upper and the lower squeeze plate.

The upper and lower segmented-squeeze feet 6*a*, 6*a*, 7*a*, 7*a* can be inserted into the openings of the upper and the lower flask 2, 3 that have no match plate 5 so that the segmented-squeeze feet can be taken out.

Figure 9:
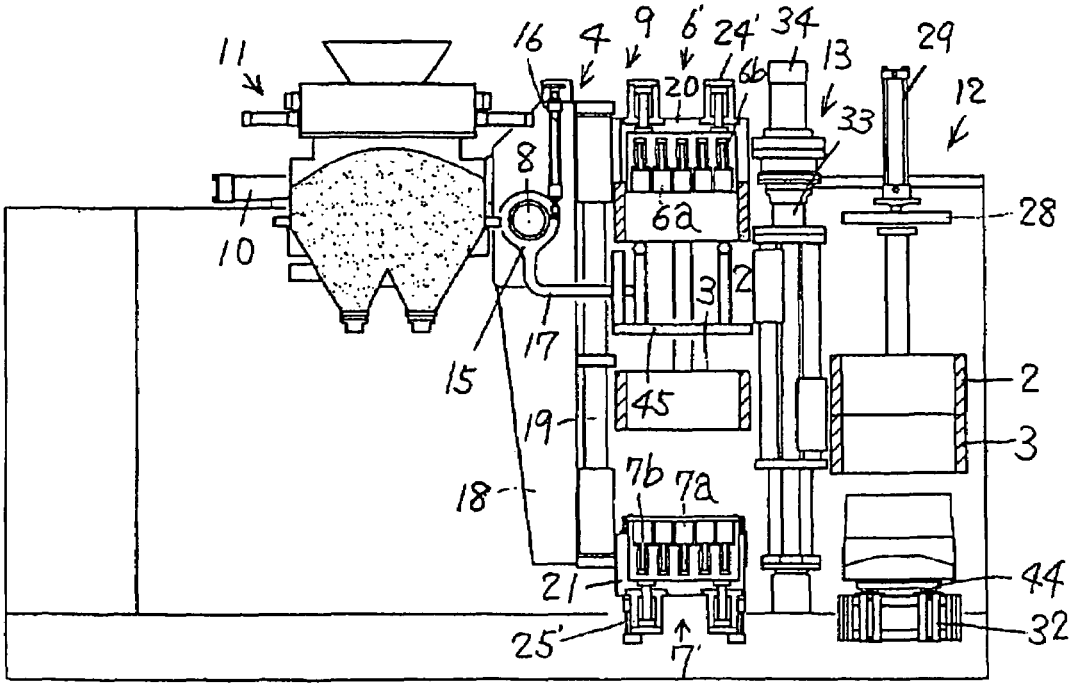
FIG. 9 shows a partial section view of FIG. 8.
Figure 10:
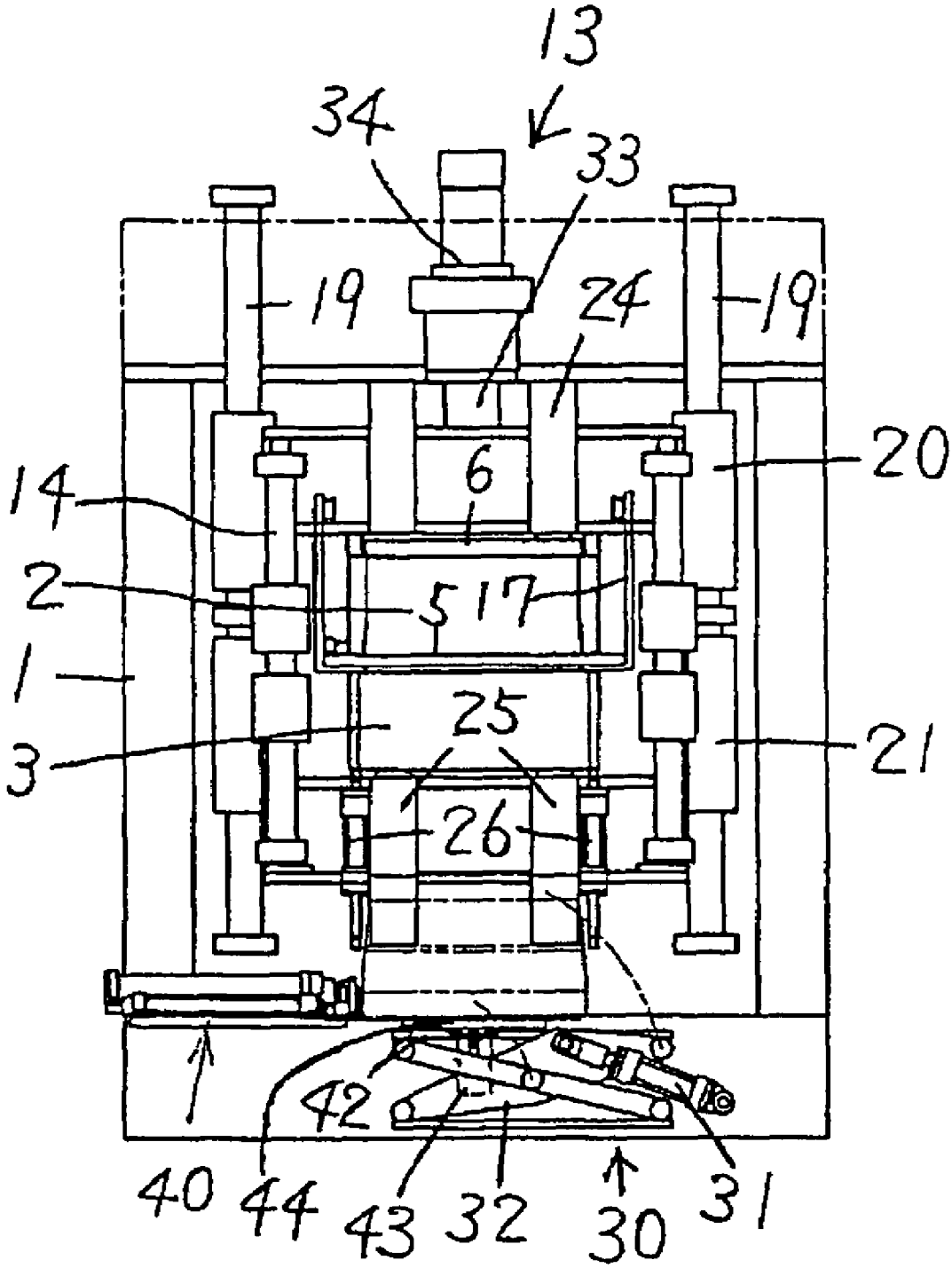
FIG. 10 shows an A-A section of FIG. 8.
Figure 11:
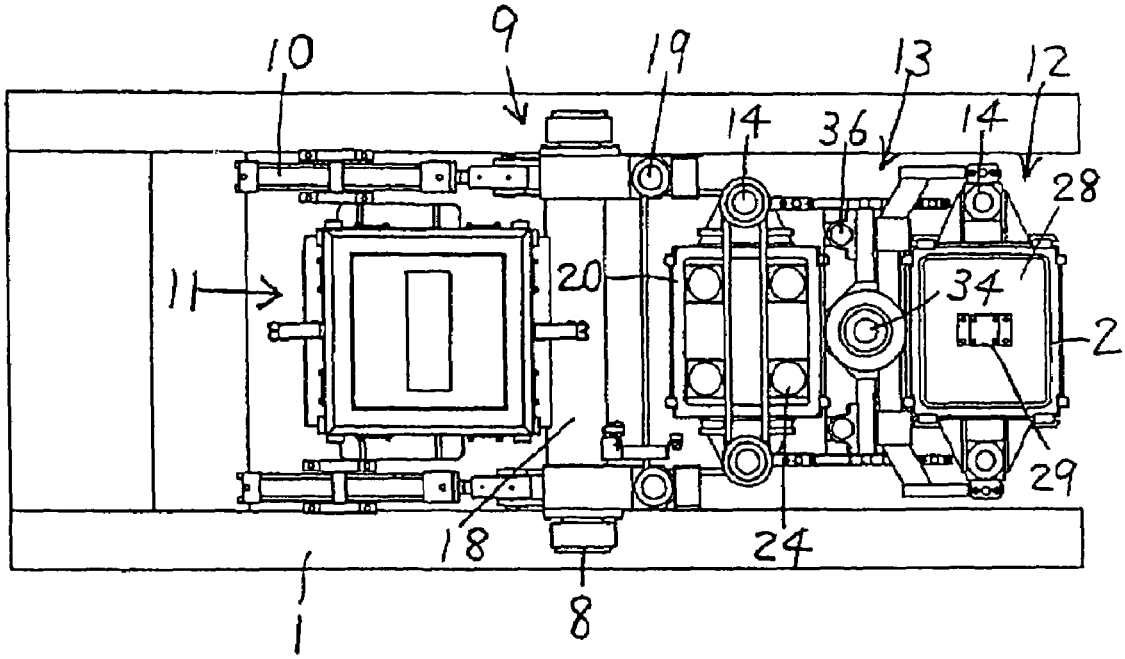
FIG. 11 shows a plane view and a partial sectional view of FIG. 8.

A plurality of cylinders 24', 24' are disposed at the upper lifting and lowering frame 20 to move an upper squeeze plate 6' forward and backward as shown in FIG. 9. A plurality of cylinders 25', 25' are disposed at the lower lifting and lowering frame 21 to move a lower squeeze plate 7' forward and backward.

A plurality of the upper segmented-squeeze feet 6*a*, 6*a* can move forward and backward by driving a plurality of the cylinders 6*b*, 6*b*. A plurality of the lower segmented-squeeze feet 7*a*, 7*a* can move forward and backward by driving a plurality of the cylinders 7*b*, 7*b*.

The upper and the lower lifting and lowering frame 20, 21 have large horizontal flat surfaces so as to push the upper and the lower flask 2, 3, which are similar to the apparatus using the upper and the lower squeeze plate, as the upper and the lower squeeze means for molding the upper and the lower mold having no flask.

The difference between the apparatus using the upper and lower segmented-squeeze feet as the upper and the lower squeeze means and using the upper and the lower squeeze plate as the ones for molding the upper and the lower mold having no flask is explained above.

These two apparatuses are comprised of the same elements, except for the different elements explained above.

Below, the second embodiment of the removing mechanism 12, which can be installed in two types of the apparatus for molding the molds explained above, is now explained in detail based on FIGS. 15 and 16.

The second embodiment of the removing mechanism is comprised of:

a supporting member 119 having a configuration of a rectangular plate to support the molds, wherein the supporting member 119 can be lifted, lowered, and inserted into the lower flask 3, a lower air cylinder 120 disposed under the supporting member 119 to lift and lower the supporting member 119, a lower lifting and lowering table 121, wherein the lower air cylinder 120 is disposed under the lower lifting and lowering table 121, a lower toggle mechanism 122 to lift and lower the lower lifting and lowering table 121, which is disposed under the lower lifting and lowering table 121, a pushing member 123 disposed above the supporting member 119 at a set distance away that can move up and down, and that can be inserted in the upper flask 2, to press the molds out, an upper hydraulic cylinder 124 disposed above the pushing member 123 to lift and lower the pushing member 123, an upper lifting and lowering table 125, wherein the upper hydraulic cylinder 124 is disposed above the upper lifting and lowering table 125, and an upper toggle mechanism 126 disposed above the upper lifting and lowering table 125 to lift and lower the upper lifting and lowering table 125.

As shown in FIG. 15, the lower toggle mechanism is comprised of:

a lower base table 127 having a horizontal and flat surface, two pairs of toggle main structures 128, 128 disposed between the upper surface of the lower base table 127 and the lower surface of the lower lifting and lowering table 121, and a cylinder 129 disposed horizontally between the two pairs of the toggle main structures 128, 128.

The lower toggle mechanism can lift and lower the lower lifting and lowering table 121 by driving the cylinder 129.

The upper toggle mechanism 126 is also comprised of:

an upper base table 130 having a horizontal and flat surface, two pairs of toggle main structures 131, 131 disposed between the lower surface of the upper base table 130 and the upper surface of the upper lifting and lowering table 125, and a cylinder 132 disposed horizontally between the two pairs of the toggle main structures 131, 131, which are similar to the lower toggle mechanism.

The upper toggle mechanism can lift and lower the upper lifting and lowering table 125 by driving the cylinder 132.

In this embodiment, the upper and the lower toggle mechanism are used as the upper and the lower folding and retracting mechanism. However, the upper and the lower folding and retracting mechanism are not limited to the upper and the lower toggle mechanism.

A pantograph mechanism can be used as the folding and retracting mechanism.

The processes for molding the upper and the lower mold having no flask by the apparatus using the squeeze plates as the squeeze means are now explained in detail based on FIG. 1.

First, the match plate 5 is inserted between a pair of the upper and the lower flask 2, 3, which are horizontal, by driving the cylinder 16 of the conveying apparatus 4 so that a pair of the arms 17, 17 can rotate. Next, while the upper flask 2 is being slightly moved up and down by driving the cylinder 38, the pair of the arms 17, 17 are released from the carriage 45 by driving the cylinder 16 of the conveying apparatus 4 so that the pair of the arms 17, 17 can rotate clockwise and are returned to the initial position.

Then, the upper and the lower flask 2, 3 approach each other by means of driving the cylinder 22, which is arranged upward, and the cylinder 23, which is arranged downward, of the squeezing mechanism 9, so that the upper and the lower lifting and lowering frame 20, 21 can approach each other.

Next, while the upper and the lower flask 2, 3 are holding the match plate 5 between them, the upper squeeze plate 6 and the lower squeeze plate 7 are inserted into the upper and the lower flask 2, 3 at a predetermined depth to define the upper and the lower molding space by driving a plurality of the cylinders 24, 24, 25, 25 of the squeezing mechanism 9.

Then, the pair of the upper and the lower flask 2, 3 and the match plate 5 become perpendicular by driving the cylinder 10 so that the squeezing mechanism 9 rotates clockwise about the supporting shaft 8.

Figure 4:
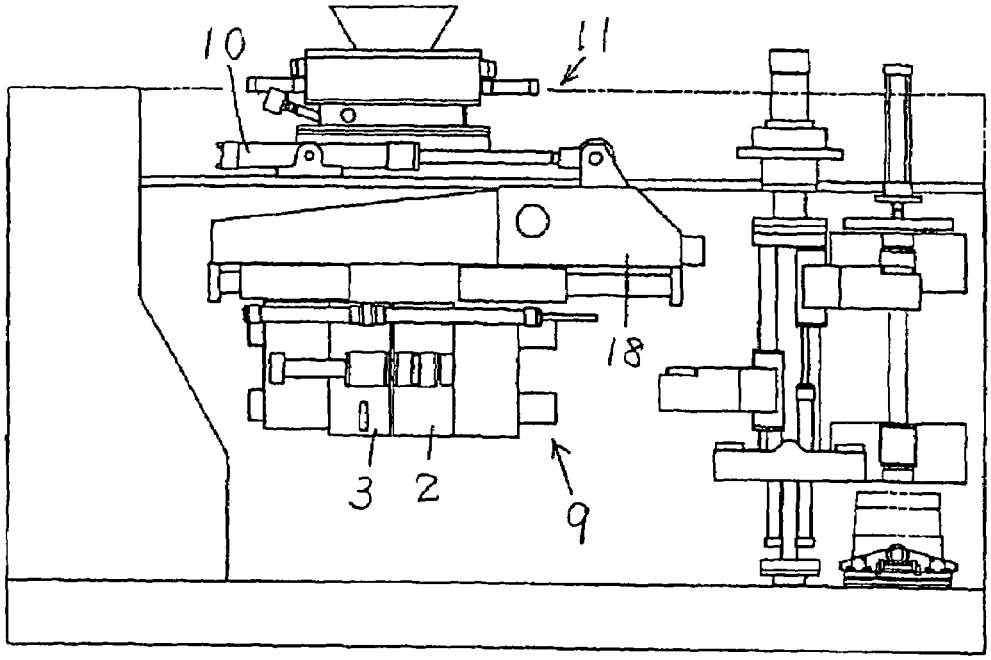
FIG. 4 shows an operational view indicating some of the processes for molding a mold, and the condition wherein foundry sand is discharged into an upper and a lower flask by the apparatus shown in FIG. 1.

The intakes for foundry sand are moved upward and caused to contact the lower ends of the two aeration tanks 27, 27 of the aeration mechanism 11. (See FIG. 4.)

In this case, while the upper and the lower molding space are being defined, the squeezing mechanism 9 may be rotated clockwise about the supporting shaft 8 by driving the cylinder 10.

Further, after the upper and the lower molding space are defined, the squeezing mechanism 9 may be rotated clockwise about the supporting shaft 8 by driving the cylinder 10.

Then, the upper and the lower molding space are filled with the foundry sand by discharging the foundry sand from the aeration mechanism 11 through the intakes.

The foundry sand in the upper and the lower molding space is squeezed by moving the upper and the lower squeeze plate 6, 7 forward.

The upper and the lower flask and the match plate are rotated so that they are horizontal.

In this case, the process for squeezing the foundry sand and the process for rotating the upper and the lower flask and the match plate so that they are horizontal may be carried out simultaneously. Otherwise, either of them may be carried out before the other.

The process to fill the foundry sand and the squeezing process may be carried out by the following two-stage process. Namely, the upper and the lower molding space are filled with the foundry sand by discharging the foundry sand from the aeration mechanism 11 through the intakes, and then the upper and the lower squeeze plate 6, 7 are moved backward to retract the squeeze plates 6, 7 to a position near the opening of a pair of the upper and the lower flask by driving a plurality of the cylinders 24, 24, 25, 25.

Next, the upper and the lower molding space are also filled with the foundry sand by discharging the foundry sand from the aeration mechanism 11 through the intakes, and while the upper and the lower flask 2, 3 and the match plate 5 are rotated so that they are horizontal, the foundry sand in the upper and the lower molding space is squeezed by driving a plurality of the cylinders 24, 24, 25, 25 so that the upper and the lower squeeze plate 6, 7 move forward.

In the process for filling and squeezing the foundry sand, the upper and lower squeeze plates 6, 7 are moved backward to retract the squeeze plates 6, 7 to a position near the opening of the pair of the upper and the lower flask, after the upper and the lower molding space defined by inserting the upper and lower squeeze plates 6, 7 in the upper and the lower flask 2, 3 are filled with the foundry sand.

However, while the upper and the lower molding space defined by inserting the upper and lower squeeze plates 6, 7 in the upper and the lower flask 2, 3 are being filled with the foundry sand, the upper and the lower squeeze plate 6, 7 may move backward to retract the squeeze plates 6, 7 to a position near the opening of the pair of the upper and the lower flask.

As mentioned above, by using the two-stage process for filling and squeezing the foundry sand, it is possible to increase the hardness of the foundry sand near the opening of the upper and lower flasks 2, 3.

After the process for filling and squeezing the foundry sand is completed, the upper and the lower lifting and lower frame 20, 21 are moved apart from each other by driving the cylinder 22, which is arranged upward, and the cylinder 23, which is arranged downward.

Then, the upper flask 2, containing the mold molded by squeezing the foundry sand, is hung by the upper hooks 37, and is separated from the match plate 5.

The lower flask 3 is positioned on the lower hooks 39 of the rotating mechanism 13, and then the match plate 5, which is located between the upper and the lower flask 2,3, is carried out by driving the cylinder 16 so that the arms 17, 17 are rotated.

Next, the upper and lower flasks 2, 3, containing the molds, are moved to the position of the removing mechanism 12 by driving the motor 34 of the rotating mechanism 13 so that the rotating shaft 33 can be rotated by a predetermined angle, and if necessary, after the core is set, the upper flask 2, containing the mold, is matched to the lower flask 3 by driving the cylinder 38 so that the upper flask 3, located on the upper hooks 37, can descend.

Then, the upper and lower flasks 2, 3, containing the molds, are put on the supporting table 30 by driving the cylinder 31 of the removing mechanism 12 so that the supporting table can ascend.

After the pushing member 28 is put on the upper surface of the upper flask 2 by driving the cylinder 29 of the removing mechanism 12, the molds are removed from the upper and the lower flask 2, 3 by driving the cylinder 31 so that the pushing member 28 and the supporting table 30 can descend together.

Then, the upper and the lower mold on the supporting table 30 are pressed out by the apparatus for taking out the lower mold 40.

In the above processes, while the upper and lower flasks 2, 3 are rotated and moved to the position of the removing mechanism 12, if necessary, after the core is set in the mold which has already been made, the pair of the upper and the lower flask 2,3 are matched to each other, and the molds are removed from the flasks, wherein these processes are similar to the method mentioned above.

Next, the processes for replacing the match plates of the apparatus for molding the molds having no flask are explained in detail.

Figure 5:
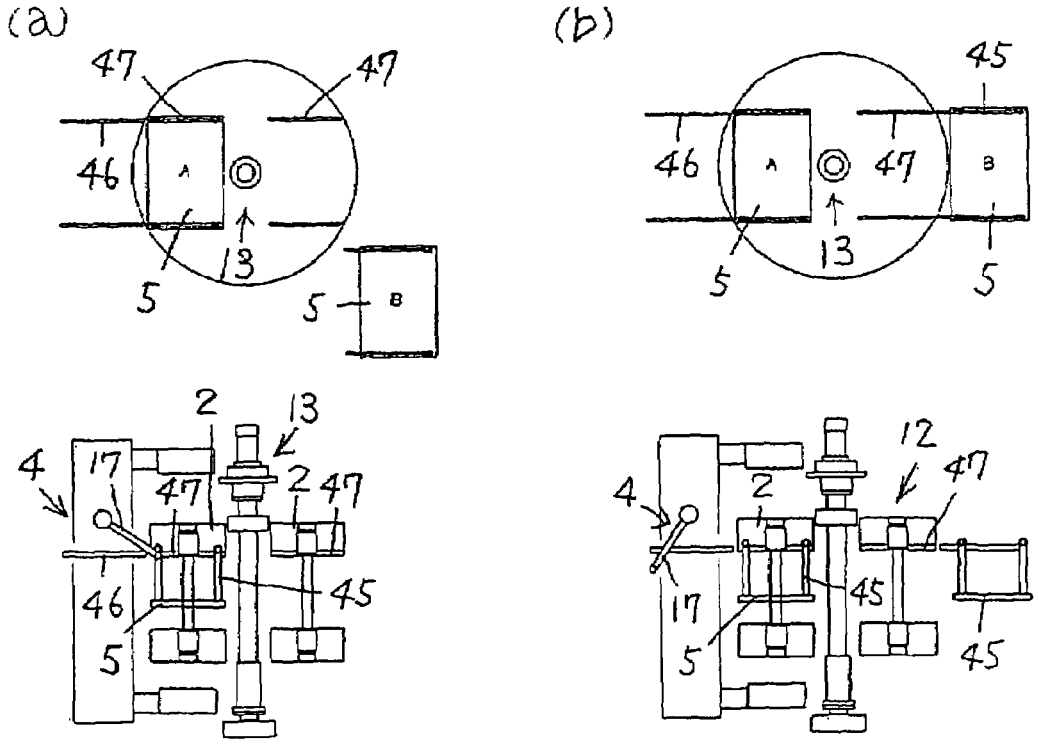
FIG. 5(*a*) shows an operational view indicating some of the processes for replacing a match plate using the apparatus shown in FIG. 1, and consists of a plane view located at the upper part and an elevational view located at the lower part.

As shown in FIG. 5(*a*), after the upper flasks 2, 2 are hung by driving the cylinders 38, 38 of the rotating mechanism 13 so that the upper flasks 2, 2 on the upper hooks 37, 37 can ascend, the carriage 45, having the match plate 5(A) on it, is transferred from the rails 46 to the rails 47 of the upper flask 2 by driving the cylinder 16 of the conveying apparatus 4 so that a pair of the arms 17, 17 rotate counterclockwise. Then, the match plate 5(A) is transferred to the upper flask 2, located at the left side.

As shown in FIG. 5(*b*), while the upper flask 2 is being moved slightly up and down by driving the cylinder 38, the pair of the arms 17, 17 are released from the carriage 45 by driving the cylinder 16 of the conveying apparatus 4 so that the pair of the arms 17, 17 can rotate clockwise and are returned to the initial position. Further, the carriage 45, having the match plate 5(B) on it to be replaced, which is hung from the rails disposed at a transfer apparatus, and which is waiting at the removing mechanism 12, moves to the position that is opposed to the rails 47 of the upper flask 2, which is at the right side of the apparatus and which is located at the removing mechanism 12.

Figure 6:
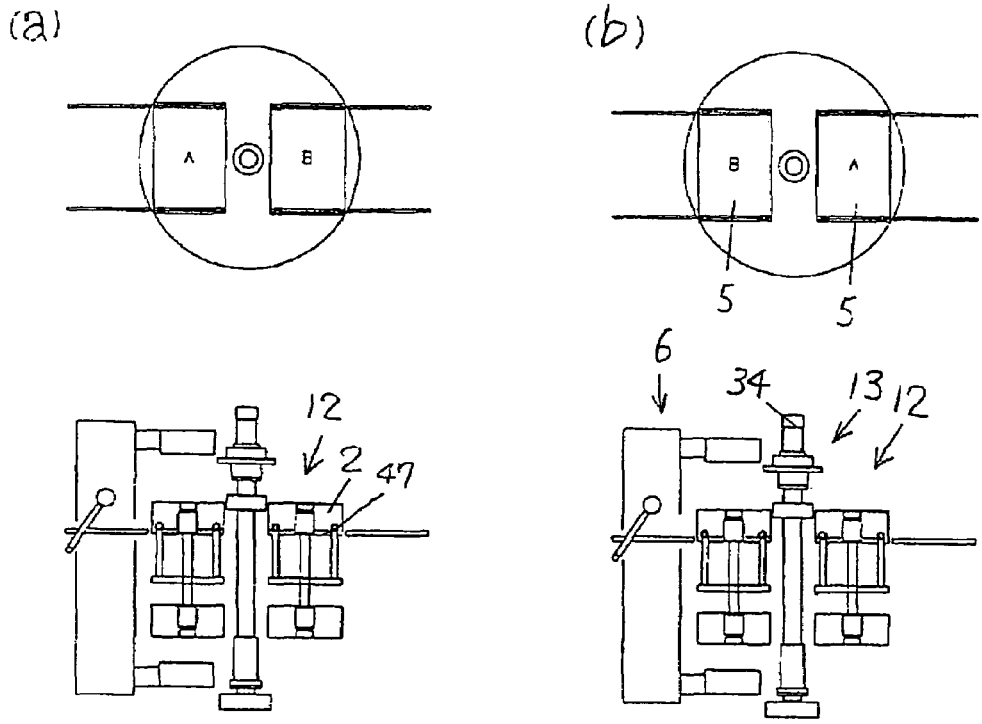
FIG. 6(*a*) shows an operational view indicating some of the processes for replacing a match plate using the apparatus shown in FIG. 1, and consists of a plane view located at the upper part and an elevational view located at the lower part.

As shown in FIG. 6(*a*), the carriage 45, disposed at the position that is opposed to the rails 47 of the upper flask 2, which is located at the right side of the apparatus, and located at the removing mechanism 12, is manually moved on the rails 47. The match plate 5(B), positioned at the right side, is moved to the upper flask, positioned at the right side, then the match plate 5(A), positioned at the squeezing mechanism 9, is rotated and moved to the removing mechanism 12, and the match plate 5(B), positioned at the removing mechanism 12, is rotated and moved to the squeezing mechanism 9 by driving the motor 34 of the rotating mechanism, as shown in FIG. 6(*b*).

Figure 7:
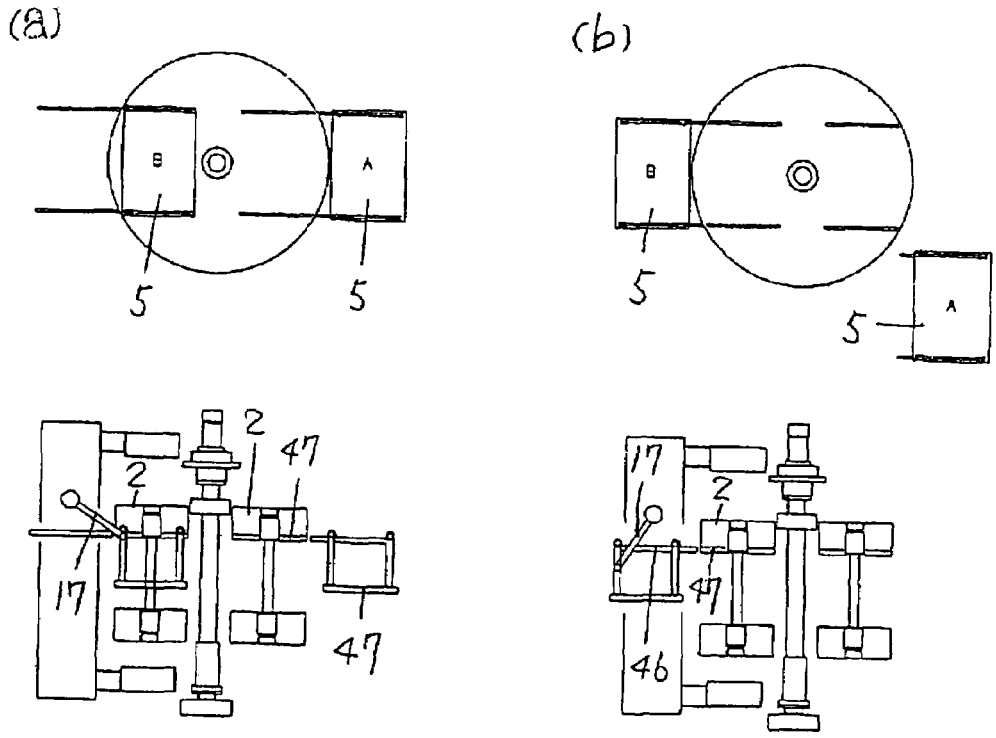
FIG. 7(*a*) shows an operational view indicating some of the processes for replacing a match plate using the apparatus shown in FIG. 1, and consists of a plane view located at the upper part and an elevational view located at the lower part.

Then, as shown in FIG. 7(*a*), a pair of the arms 17, 17 are connected to the carriage 45 having the match plate 5(B) on it by driving the cylinder 16 so that the pair of the arms 17, 17 can rotate counterclockwise, while the upper flask 2 is being moved up and down for a small distance by driving the cylinder 38.

Next, a carriage 45 having the match plate 5(A) on it is moved from the rails 47 of the upper flask 2 to the outside of the apparatus, and the carriage 45 having the match plate 5(B) is moved from the rails 47 of the upper flask 2 to the rails 46 by driving the cylinder 16 of the conveying apparatus 4 so that the pair of the arms 17, 17 can rotate clockwise, and then the match plate 5(B) is moved from the upper flask 2. The carriage 45, having the match plate 5(A) and being removed from the rails 47, is moved to a proper place by a proper transfer means. Consequently, the process for replacing the match plate 5 is completed.

Processes for molding the upper and the lower mold having no flask by the apparatus using the segmented-squeeze feet as the squeeze means are explained in detail based on FIG. 8.

First, the match plate 5 is inserted between a pair of the upper and the lower flask 2, 3 which are horizontal, by driving the cylinder 16 of the conveying apparatus 4 so that the pair of the arms 17, 17 can rotate. (See FIG. 9.)

Then, the upper and the lower flask 2, 3 approach each other by driving the cylinder 22, which is arranged upward, and the cylinder 23, which is arranged downward, of the squeezing mechanism 9, so that the upper and the lower lifting and lowering frame 20, 21 can approach each other, and by driving the cylinder 38 so that the upper hooks 37 can descend.

Next, while the upper and the lower flask 2, 3 are holding the match plate 5 between them, a plurality of the upper and lower segmented-squeeze feet 6*a*, 6*a*, 7*a*, 7*a* are inserted in the upper and the lower flask at a predetermined depth to define the upper and the lower molding space by driving a plurality of the cylinders 24, 24, 25, 25 of the squeezing mechanism 9.

Then, the pair of the upper and the lower flask 2, 3 and the match plate 5 become perpendicular by driving the cylinder 10 so that the squeezing mechanism 9 rotates clockwise about the supporting shaft 8.

The intakes for foundry sand are moved upward and contact the lower ends of the two aeration tanks of the aeration mechanism 11. (See FIG. 12(*a*).)

In this case, while the upper and the lower molding space are being defined, the squeezing mechanism 9 may be rotated clockwise about the supporting shaft 8 by driving the cylinder 10.

Further, after the upper and the lower molding space are defined, the squeezing mechanism 9 may be rotated clockwise about the supporting shaft 8 by driving the cylinder 10.

A plurality of the upper and lower segmented-squeeze feet 6*a*, 6*a*, 7*a*, 7*a* of the upper and the lower squeeze means are moved for a predetermined distance so that each of the respective ratios of the distance between each of the upper and lower segmented-squeeze feet 6*a*, 6*a*, 7*a*, 7*a* and the match plate 5 before squeezing the foundry sand to that after squeezing becomes almost equal.

When, as shown in FIG. 12(*b*), the distances between a plurality of the upper and lower segmented-squeeze feet 6*a*, 6*a*, 7*a*, 7*a* and the corresponding portion of the match plate 5 before squeezing the foundry sand are defined as "A" and "B,"

and, as shown in FIG. 12(*c*), those after squeezing are defined as "a" and "b," the segmented-squeeze feet 6*a*, 6*a*, 7*a*, 7*a* are moved so that the ratios of "a/A" and "b/B" can have the relation close to "a/A=b/B."

Namely, when the height of the portion of the match plate is high, the upper and lower segmented-squeeze feet 6*a*, 6*a*, 7*a*, 7*a* are moved so that the quantity of the foundry sand at the position corresponding to the portion becomes less, and when the height of the portion of the match plate is low, they are not moved too much, so that the quantity of the foundry sand at the position corresponding to the portion becomes greater.

Then, the upper and the lower molding space are filled with the foundry sand by discharging the foundry sand from the aeration mechanism 11 through the intakes of the upper and the lower flask 2, 3.

The foundry sand in the upper and lower molding space is squeezed by driving a plurality of the cylinders 24, 24, 25, 25, so that a plurality of the upper and lower segmented-squeeze feet 6*a*, 6*a*, 7*a*, 7*a* can move forward, while the pair of the upper and the lower flask 2, 3 and the match plate are being rotated so that they become horizontal.

Next, after a plurality of the upper and lower segmented-squeeze feet 6*a*, 6*a*, 7*a*, 7*a* are retracted by driving a plurality of the cylinders 24, 24, 25, 25, the segmented-squeeze feet 6*a*, 6*a*, 7*a*, 7*a* are moved further forward by driving the cylinders 24, 24, 25, 25.

By these processes, the density of the foundry sand of the upper and the lower mold can become uniform, and the surface opposed to the upper and lower segmented-squeeze feet 6*a*, 6*a*, 7*a*, 7*a* of the foundry sand in the flasks 2, 3 can also become flat. (See FIG. 12(*c*).)

The upper and the lower lifting and lowering frame 20, 21 are moved apart from each other by driving the cylinder 22, arranged upward, and the cylinder 23, arranged downward.

Then, the upper flask 2, containing the mold molded by squeezing the foundry sand, is hung by the upper hooks 37, and is separated from the match plate 5 by driving the cylinder 38 of the rotating mechanism 13. The lower flask 3 is positioned on the lower hooks 39 of the rotating mechanism 13, and then the match plate 5, which is located between the upper and the lower flask 2, 3, is carried out by driving the cylinder 16 so that the arms 17, 17 can rotate.

Next, the upper and lower flasks 2, 3, containing the mold, are moved to the position of the removing mechanism 12 by driving the motor 34 of the rotating mechanism 13 so that the rotating shaft 33 can rotate to a predetermined angle, and if necessary, after the core is set, the upper flask 2, containing the mold, is matched to the lower flask 3 by driving the cylinder 38 so that the upper flask 2 on the upper hooks 37 can descend. (See FIG. 10.)

Then, the upper and the lower flask 2, 3, containing the mold, are put on the supporting table 44 by driving the cylinder 43 of the supporting device 30 so that the supporting table 44 can ascend, and by driving the cylinder 31 so that the supporting table 44 on the lifting and lowering table 42 can further ascend.

After the pushing member 28 is put on the upper surface of the upper flask 2 by driving the cylinder 29 of the removing mechanism 12, the upper and the lower mold are removed from the upper and the lower flask 2, 3 by driving the cylinder 31 so that the pushing member 28 and the supporting table 44 can descend together.

Then, the upper and the lower mold on the supporting table 44 and the lifting and lowering table 42 are further caused to descend by driving the cylinder 31, and are pressed out by the apparatus for taking out the molds 40.

In the above processes, while the upper and the lower flask 2, 3 are being rotated and moved to the position of the removing mechanism 12, if necessary, after the core is set in the mold which has been molded already, the pair of the upper and the lower flask 2, 3 containing the mold may be matched to each other, and then the molds may be removed from the flasks. This process is similar to the method mentioned above.

In this preferred embodiment, when the distances between a plurality of the upper and lower segmented-squeeze feet 6*a*, 6*a*, 7*a*, 7*a* and the corresponding portion of the match plate 5 before squeezing the foundry sand are defined as "A" and "B," and those after squeezing are defined as "a" and "b," the segmented-squeeze feet 6*a*, 6*a*, 7*a*, 7*a* are moved so that the ratios of "a/A" and "b/B" can have the relation of close to "a/A=b/B," to thereby make the density of the foundry sand of the upper and the lower mold become uniform, and to make the surface of the foundry sand in the flasks 2, 3 opposed to the upper and lower segmented-squeeze feet 6*a*, 6*a*, 7*a*, 7*a* also become flat.

However, the method for molding the molds is not limited to this process.

For example, as shown in FIGS. 13(*a*)-13(*c*), after the space between the match plate 5 and a plurality of the upper and lower segmented-squeeze feet 6*a*, 6*a*, 7*a*, 7*a* opposed to the match plate 5 is formed so that the foundry sand can easily flow in the space, the molds may be molded by discharging the foundry sand into the molding space through the intakes of the upper and the lower flask 2, 3.

It is possible to reduce the friction between the foundry sand and a wall of an aeration tank by jetting air into a nozzle (especially, a nozzle throat) of the aeration tank and a portion where it is difficult for the foundry sand to flow to make the foundry sand easily flow in the space between a plurality of the upper and lower segmented-squeeze feet 6*a*, 6*a*, 7*a*, 7*a* and the match plate 5.

As shown in FIGS. 14(*a*)-14(*b*), the following process may also be acceptable.

Namely, after the upper and the lower molding space, which are perpendicular, are defined by the match plate 5, by the upper and the lower flask 2, 3, and by a plurality of the upper and lower segmented-squeeze feet 6*a*, 6*a*, 7*a*, 7*a*, acting as the upper and the lower squeeze means, then the foundry sand is discharged into the upper and the lower molding space through the intakes of the upper and the lower flask 2, 3.

Then the foundry sand in the molding space is squeezed by driving a plurality of the cylinders 6*b*, 6*b*, 7*b*, 7*b* so that a plurality of the segmented-squeeze feet 6*a*, 6*a*, 7*a*, 7*a* can move forward.

Next, after a plurality of the upper and lower segmented-squeeze feet 6*a*, 6*a*, 7*a*, 7*a* are retracted by driving a plurality of the cylinders 6*b*, 6*b*, 7*b*, 7*b*, the foundry sand is further discharged into the upper and the lower molding space through the intakes.

Then, the squeezing surfaces of a plurality of the upper and lower segmented-squeeze feet 6*a*, 6*a*, 7*a*, 7*a* are arranged in a flat plane, and the foundry sand in the upper and the lower molding space is further squeezed by driving a plurality of the cylinders 19, 19, 20, 20 so that a plurality of the upper and lower segmented-squeeze feet 6*a*, 6*a*, 7*a*, 7*a* can move forward together.

Further, a plurality of the upper and lower segmented-squeeze feet 6*a*, 6*a*, 7*a*, 7*a*, integrated with some of a plurality of the upper and lower segmented-squeeze feet 6*a*, 6*a*, 7*a*, 7*a*, can be used.

When the upper and the lower mold that have no flask are molded by the apparatus using the segmented-squeeze feet as the squeeze means for molding the molds, the method for replacing the match plate is the same as that used in molding the molds by the apparatus using the squeeze plates as the squeeze means.

Below, the method for removing the molds by using the second embodiment of the removing mechanism 12 is explained in detail based on FIGS. 15-20.

After the foundry sand in the upper and the lower molding space is squeezed, the upper and the lower lifting and lowering frame 20, 21 are separated from each other, and the upper flask containing the mold molded by squeezing the foundry sand is raised by using the upper hooks 37 and by driving the cylinder 38 of the rotating mechanism 13, and is separated from the match plate 5.

Then, the lower flask 3 is put on the lower hooks 39 of the rotating mechanism 13, and the match plate 5 is removed from the area between the upper and the lower flask 2, 3.

Next, the upper and the lower flask 2, 3, containing the mold, are moved to the removing mechanism 12 by driving the motor 34 of the rotating mechanism 13 so that the rotating shaft 33 can rotate over a predetermined angle. If necessary, after the core is set in the mold, the upper flask 2 on the upper hooks 37 is lowered and matched to the lower flask 3.

Then, after the upper and the lower flask 2, 3 are held between the upper and the lower lifting and lowering table 125, 121 by driving the cylinders 132,129 of the upper and the lower toggle mechanism 126,122 so that the lifting and lowering tables 125, 121 can approach each other as shown in FIG. 18(*a*), the supporting member 119 contacts the lower surface of the lower mold by driving the air cylinder 120 as shown in FIG. 18(*b*).

Next, after the pushing member 123 contacts the upper surface of the upper mold by driving the hydraulic cylinder 124 as shown in FIG. 19(*a*), the pushing member 123 and the supporting member 119 are lowered by driving the hydraulic cylinder 124 and air cylinder 120 together as shown in FIG. 19(*b*).

Then, the upper and the lower lifting and lowering table 125, 121 are separated from each other by driving the cylinders 132, 129 of the upper and the lower toggle mechanism 126, 122. The upper and the lower mold "A" and "B" can be removed from the upper and the lower flask 2, 3 by these processes.

In these processes, while the upper and the lower flask 2, 3 containing the mold are being rotated and moved to the removing mechanism 12, then, if necessary, after the core is set in the mold, a pair of the upper and the lower flask 2, 3 containing the mold can be matched, and then the molds can be removed from them.

What we claim is:

1. A method for molding an upper and a lower mold having no flask by using two pairs of an upper and a lower flask, which are horizontal and have intakes for foundry sand and of which each pair can alternately and intermittently rotate comprising:

(1) a putting and holding process to put a match plate having a pattern in between an upper and a lower flask of one pair of two pairs of an upper and lower flask having intakes for foundry sand and being horizontal and to hold the match plate, (2) a defining process to define an upper and a lower molding space by inserting an upper and a lower squeeze means into openings of the pair of the upper and the lower flask having no match plate, (3) a rotating and moving process to rotate the pair of the upper and the lower flask and the match plate together with the upper and the lower squeeze means and cylinders to move the upper and lower squeeze means so that they are perpendicularly positioned, and to move them so that the intakes of the upper and the lower flask move upward, (4) a filling process to fill the upper and the lower molding space with the foundry sand through the intakes of the upper and the lower flask, (5) a squeezing process to squeeze the foundry sand in the upper and the lower molding space by causing the upper and the lower squeeze means to further approach each other, (6) a rotating process to rotate the pair of the upper and the lower flask and the match plate together with the upper and the lower squeeze means and cylinders to move the upper and lower squeeze means so that they are again horizontally positioned, (7) a removing process to remove the match plate disposed between the upper and the lower flask after separating the upper and the lower flask containing respectively an upper and a lower mold from the match plate, (8) a rotating process to alternately and intermittently rotate the pair of the upper and the lower flask containing the molds and the other pair of the upper and the lower flask from which molds made in a preceding process have been removed, (9) a matching process to match the upper and the lower flask containing the upper and the lower mold to each other, and

(10) a removing process to remove the molds from the pair of the upper and the lower flask that are caused to match each other.

2. The method of claim 1, wherein, the defining process (2) and the rotating and moving process (3) carried out simultaneously.

3. The method of claim 1, wherein the squeezing process (5) and the rotating process (6) carried out simultaneously.

4. The method of claim 1, wherein an upper and lower squeeze plate are provided as the upper and the lower squeeze means.

5. The method of claim 1, wherein upper and lower segmented-squeeze feet are provided as the upper and the lower squeeze means.

6. The method of claim 4, wherein after the filling process to fill the upper and the lower molding space with the foundry sand through the intakes of the upper and the lower flask is completed, the method further includes:

a) a process to move further apart the upper squeeze plate from the lower squeeze plate to a predetermined distance, and b) a further filling process to further fill the upper and the lower molding space with additional foundry sand through the intakes of the upper and the lower flask.

7. The method of claim 6, wherein, the process to move further apart the upper squeeze plate from the lower squeeze plate to a predetermined distance, and the further filling process to further fill the upper and the lower molding space with the additional foundry sand through the intakes of the upper and the lower flask are carried out simultaneously.

8. The method of claim 5, wherein the defining process (2) further includes a setting process to set the distance between the pattern of the match plate and each of a plurality of the upper and lower segmented-squeeze feet so that each ratio of the distance after squeezing and that before squeezing becomes the same.

9. The method of claim 5, wherein the defining process (2) further includes a forming process to form the molding space defined by the pattern of the match plate and each of a plurality of the upper and lower segmented-squeeze feet so that the foundry sand can easily flow in the molding space.

10. The method of claim 5, wherein the filling process (4) and the squeezing process (5) further include a) a first filling process to fill the upper and the lower molding space defined by the upper and the lower flask, the upper and the lower squeeze means, and the match plate, which are perpendicular, with the foundry sand through the intakes of the upper and the lower flask.

b) a first squeezing process to squeeze the foundry sand in the upper and the lower molding space by causing a plurality of the upper and lower segmented-squeeze feet of the upper and the lower squeeze means to further approach each other, c) a second filling process to fill the upper and the lower molding space with the additional foundry sand through the intakes of the upper and lower flask after a retracting process to retract the upper and lower segmented-squeeze feet, and d) a second squeezing process to squeeze the foundry sand in the upper and the lower molding space by simultaneously causing the upper and lower segmented-squeeze feet, whose surfaces are arranged in a plane, to further approach each other.

11. An apparatus for molding an upper and a lower mold that match each other and that has no flask, comprising:

(1) two pairs of an upper and a lower flask each having intakes disposed at their side walls for foundry sand, (2) a match plate having a pattern disposed between one of the two pairs of the upper and the lower flask so that the match plate can be inserted in and taken out from between one of the two pairs of the upper and the lower flask by a conveying apparatus, (3) a squeezing mechanism to squeeze the foundry sand, which supports a pair of the upper and the lower flask having the match plate between the upper and the lower flask, which supports upper and lower squeeze means inserted in openings of the upper and the lower flask having no match plate so that the squeeze means can be taken out, and which can clockwise or counterclockwise rotate in a perpendicular plane about a supporting shaft so that the pair of the upper and the lower flask having the match plate between the upper and the lower flask can become perpendicular and horizontal, (4) a driving mechanism to clockwise or counterclockwise rotate the squeezing mechanism, (5) an aeration mechanism to discharge the foundry sand into the upper and the lower flask, when both are perpendicular, by means of the driving mechanism, through the intake, (6) a removing mechanism to remove an upper and a lower mold from a pair of the upper and lower flask, and matched to each other, and which are horizontal, and (7) a rotating mechanism to alternately and intermittently rotate the two pairs of the upper and the lower flask, which are horizontal, between the squeezing mechanism, which is horizontal, and the removing mechanism, and to lift and lower the upper flask, wherein the removing mechanism to remove an upper and a lower mold includes:

a) a supporting member to support the molds which supporting member has a rectangular plate, can be lifted and lowered, and can be inserted in the lower flask, b) a lower fluid cylinder disposed under the supporting member to lift and lower the supporting member, c) a lower lifting and lowering table, wherein the lower fluid cylinder is disposed under the lower lifting and lowering table, d) a lower folding and retractable mechanism to lift and lower the lower lifting and lowering table, which is disposed under the lower lifting and lowering table, e) a pressing member to press the molds out, which pressing member has a rectangular plate, is disposed above the supporting member at a set distance away from it, and can be moved up and down and inserted in the upper flask, f) an upper fluid cylinder disposed above the pressing member to lift and lower the pressing member, g) an upper lifting and lowering table, wherein the upper fluid cylinder is disposed above the upper lifting and lowering table, and h) an upper folding and retractable mechanism to lift and lower the upper lifting and lowering table, which is disposed above the upper lifting and lowering table.

12. The apparatus of claim 11, wherein an upper and a lower squeeze plate are provided as the upper and the lower squeeze means.

13. The apparatus of claim 11, wherein upper and lower segmented-squeeze feet are provided as the upper and the lower squeeze means.

14. The apparatus of claim 11, wherein the lower and the upper folding and retractable mechanism of the removing mechanism are a toggle mechanism or a pantograph mechanism.

15. The apparatus of claim 11, wherein the upper and the lower fluid cylinder of the removing mechanism are a hydraulic cylinder and a pneumatic cylinder respectively.

16. A method for replacing a match plate in the apparatus of any one of claims 11-13 by using the rotating mechanism thereof comprising:

a) a raising process to raise two upper flasks of two pairs of the upper and the lower flask, b) a carrying process to carry a first carriage on rails disposed at the upper flask positioned at the squeezing mechanism, wherein the first carriage has an existing match plate, c) a carrying process to carry a second carriage on rails disposed at the upper flask positioned at the removing mechanism, wherein the second carriage has a new match plate, d) a moving process to move the upper flask positioned at the squeezing mechanism and the first carriage to the removing mechanism, and to simultaneously move the upper flask positioned at the removing mechanism and the second carriage to the squeezing mechanism by means of the rotating mechanism; and e) a carrying-out process to carry out the first carriage having the existing match plate from the rails disposed at the upper flask positioned at the removing mechanism, and to carry out the second carriage having the new match plate from the rails disposed at the upper flask positioned at the squeezing mechanism.

* * * * *

UNITED STATES PATENT AND TRADEMARK OFFICE

CERTIFICATE OF CORRECTION

PATENT NO. : 7,654,302 B2
APPLICATION NO. : 10/582965
DATED : February 2, 2010
INVENTOR(S) : Hirata et al.

It is certified that error appears in the above-identified patent and that said Letters Patent is hereby corrected as shown below:

In the Claims:

Claim 2, col. 18, line 33,
"and the rotating and moving process (3) carried out" should read
--and the rotating and moving process (3) are carried out--.

Claim 3, col. 18, line 36,
"(5) and the rotating process (6) carried out simultaneously" should read
--(5) and the rotating process (6) are carried out simultaneously--.

Signed and Sealed this
Sixth Day of August, 2013

Teresa Stanek Rea
*Acting Director of the United States Patent and Trademark Office*